US005450091A

United States Patent [19]

Hama

[11] Patent Number: 5,450,091

[45] Date of Patent: Sep. 12, 1995

[54] VARIABLE SIZE ANTENNA DEVICE HAVING RESONANCE FREQUENCY COMPENSATION

[75] Inventor: Norio Hama, Suwa, Japan

[73] Assignee: Seiko Epson Corporation, Tokyo, Japan

[21] Appl. No.: 42,050

[22] Filed: Apr. 2, 1993

Related U.S. Application Data

[63] Continuation-in-part of Ser. No. 870,160, Apr. 15, 1992, Pat. No. 5,243,356, which is a continuation of Ser. No. 477,867, Apr. 4, 1990, abandoned.

[30] Foreign Application Priority Data

| | | | |
|---|---|---|---|
| Aug. 5, 1988 | [JP] | Japan | 63-196833 |
| Dec. 12, 1988 | [JP] | Japan | 63-313340 |
| Jun. 29, 1989 | [JP] | Japan | 1-167372 |
| Jul. 6, 1989 | [JP] | Japan | 1-175168 |
| Sep. 9, 1992 | [JP] | Japan | 4-240703 |

[51] Int. Cl.[6] ..... H01Q 1/27; H01Q 1/44; H01Q 7/00

[52] U.S. Cl. ..... 343/718; 343/741; 343/767

[58] Field of Search ..... 343/718, 741, 742, 746, 343/767, 769; 455/274, 280, 344; H01Q 1/27, 1/44, 7/00

[56] References Cited

U.S. PATENT DOCUMENTS

| | | | |
|---|---|---|---|
| 4,922,260 | 5/1990 | Gaskiu et al. | 343/718 |
| 4,973,944 | 11/1990 | Maletta | 343/718 |
| 5,134,724 | 7/1992 | Gehring et al. | 343/718 |
| 5,243,356 | 9/1993 | Hama | 343/718 |

*Primary Examiner*—Donald Hajec
*Assistant Examiner*—Hoanganh Le
*Attorney, Agent, or Firm*—W. Douglas Carothers, Jr.

[57] ABSTRACT

An arm-attached band type radio apparatus capable of providing a stable antenna gain without being affected by the band size has an arm attaching band that is formed into a loop by way of a buckle 31 having an metallic electrode plate 32, first and second conductor plates 5L, 5R, shaped so as to form a slot antenna, to form a loop-like slot antenna. The distal end side of conductor plate 5L has an overlap capacitance changing portion 15 so that, when the connecting position of the band changes according to the thickness of the wearer's arm, the overlap capacitance between first conductor plate 5L and metallic electrode 32, is changed. The magnitude of the capacitance change corresponds to a change in the inductance of the antenna to compensate for a shift in the resonance frequency. The overlap capacitance can be changed by controlling the overlap area or the effective dielectric constant of the material separating conductor plate 5L from metallic electrode 32.

11 Claims, 21 Drawing Sheets

FIG._32
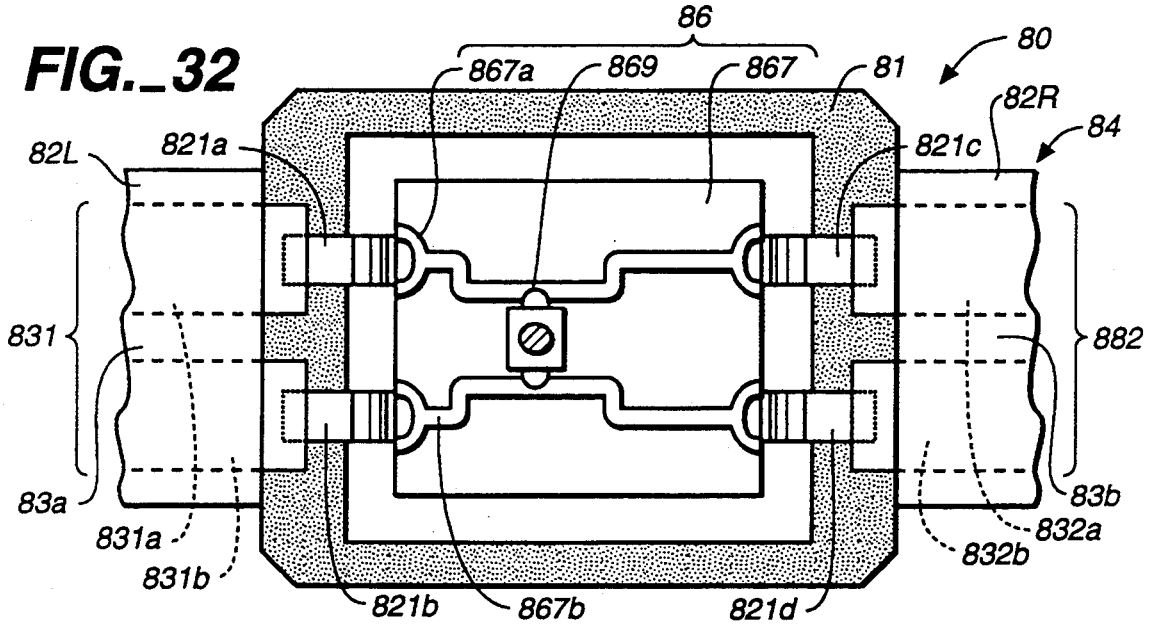
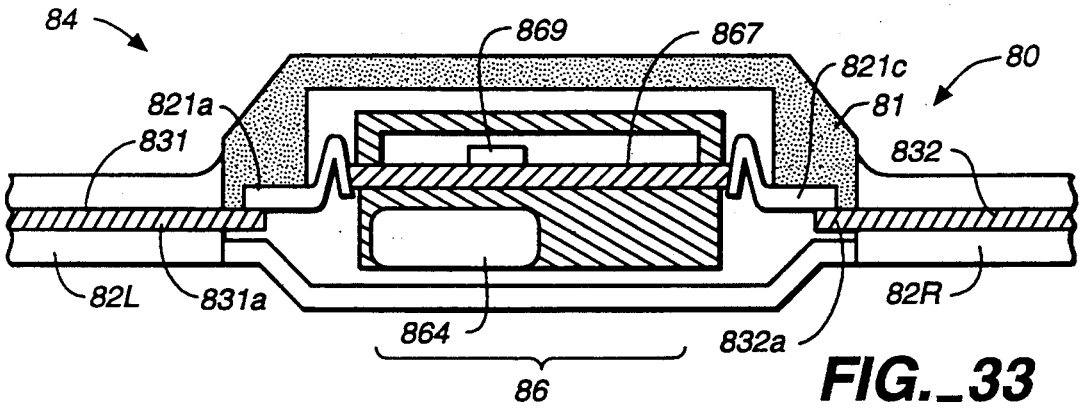
FIG._33
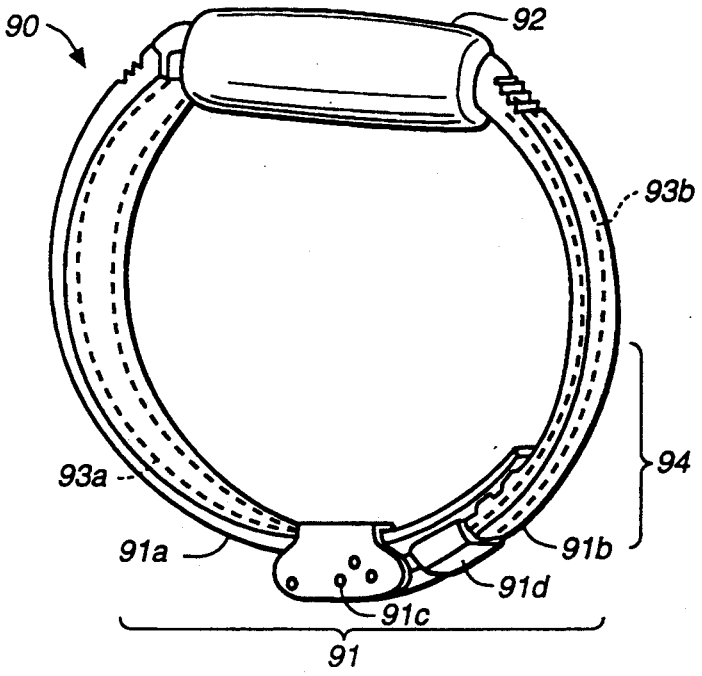
FIG._34
(PRIOR ART)

VARIABLE SIZE ANTENNA DEVICE HAVING RESONANCE FREQUENCY COMPENSATION

This application is a continuation in part of application Ser. No. 07/870,160 filed Apr. 15, 1992, now U.S. Pat. No. 5,243,356 issued Sep. 7, 1993, which is continuation of Ser. No. 07/477,867 filed Apr. 4, 1990, now abandoned.

BACKGROUND OF THE INVENTION

1. Field of the Invention

The present invention relates to an antenna device, having a circumferentially variable size, typically embedded in a wristband, for use with a radio which is generally worn on the arm of a person. More particularly, the antenna device of the present invention provides a method and apparatus for automatically compensating for changes in antenna gain and resonance frequency which result from changes in the antenna size.

2. Description of the Related Art

FIG. 34 shows an example of a conventional approach to the construction of portable radio transmitters or receivers. More particularly it shows a proposed antenna device for an arm-attached type radio apparatus capable of being carried while worn on a wrist. FIG. 34 shows an arm-attached type radio apparatus 90 that includes a case body 92 (the main body of the radio apparatus) accommodating a circuit board for the radio apparatus; and an arm attaching band 91 connected to both sides of case body 92. Attaching band 91 has first and second band members 91*a*, 91*b* formed of an insulating material. First and second band members 91*a*, 91*b* include, respectively, first and second band-like conductor plates 93*a*, 93*b* that are embedded within the band members. First and second conductor plates 93*a*, 93*b*, are electrically coupled to the radio circuit, and are electrically coupled at their free ends to band connector portions 91*c*, 91*d* of first and second band members 91*a*, 91*b*. When first and second band members 91*a*, 91*b* are connected by way of band connector portions 91*c*, 91*d*, first and second conductor plates 93*a*, 93*b* form a loop through circuit 94, thus forming an antenna 95 as shown in FIG. 35. In radio apparatus circuit 94, a high-frequency amplifier circuit 94*b* is coupled via coupling capacitor 94*a* to first conductor plate 93*a*, and a variable capacitor 94*c* is connected between first conductor plate 93*a* and ground. Note that the side of second conductor plate 93*b* is fixed at ground potential.

However, because the thickness of a wearer's wrist varies, there is a problem with antenna 95. That is, depending on the connecting position of first and second band members 91*a*, 91*b*, the circumference thereof varies and consequently, the antenna inductance value changes, and antenna gain is lowered. In other words, because, the inductance of antenna 95 is changed as the band size is changed by the wearer, the resonance frequency is shifted and antenna gain is lowered.

In view of the above problems, an object of the present invention is to achieve an antenna device for arm-attached type radios capable of obtaining a stable gain without being affected by the difference in the band size of the wearer.

SUMMARY OF THE INVENTION

The antenna device of the present invention includes a band connector portion for bringing the free ends of the insulating band members to a state where they are separated or to a state where they are connected to make the band members capable of being attached for example to a wrist; a conductor plate fixed to the band members, for constructing a loop-like antenna in the state where the band members are connected by the band connector portion; and a resonance frequency compensation means for changing the magnitude of the overlap capacitance formed between the conductor plate and an electrode unit provided on the band connector portion according to the connecting position of the free end sides of the band members. This change in capacitance corresponds with the change in antenna inductance attributable to a change in the band member connecting positions.

Resonance frequency compensation can be achieved using: (1) an area changing portion on the side of the conductor plate, which causes a change in the magnitude of the overlap capacitance by changing the opposing area between the electrode unit and the conductor plate according to the connecting position of the band members; (2) an effective-dielectric-constant changing portion on the side of the band member; or (3) a thickness changing portion on the side of the band member. Thus the product of the inductance and the overlap capacitance is kept constant and the resonance frequency does not change even when the inductance of the antenna is changed by the connecting position of the free end side of the band member, since, in accordance with such change, the electric coupling capacitance also changes. Thus, a stable antenna gain may be obtained without being affected by the difference in the band size of the wearer.

In the present invention, it is preferred that a slit be formed in the conductor plate in the lengthwise direction so as to make the antenna function as a slot antenna. Since such antenna is provided with a slit opening toward the outer periphery, the directivity in the circumferential direction of the antenna is improved.

Other objects, advantages and attainments together with a fuller understanding of the invention will become apparent and appreciated by referring to the following description and claims taken in conjunction with the accompanying drawings.

BRIEF DESCRIPTION OF THE DRAWINGS

FIG. 32 is a cross-sectional view of an apparatus according to a modified example of Embodiment 4 of the present invention.

FIG. 33 is a longitudinal section of the apparatus of FIG. 32.

FIG. 34 shows a conventional arm-attached type radio apparatus.

DETAILED DESCRIPTION OF THE INVENTION

Embodiment 1

Figure 1:
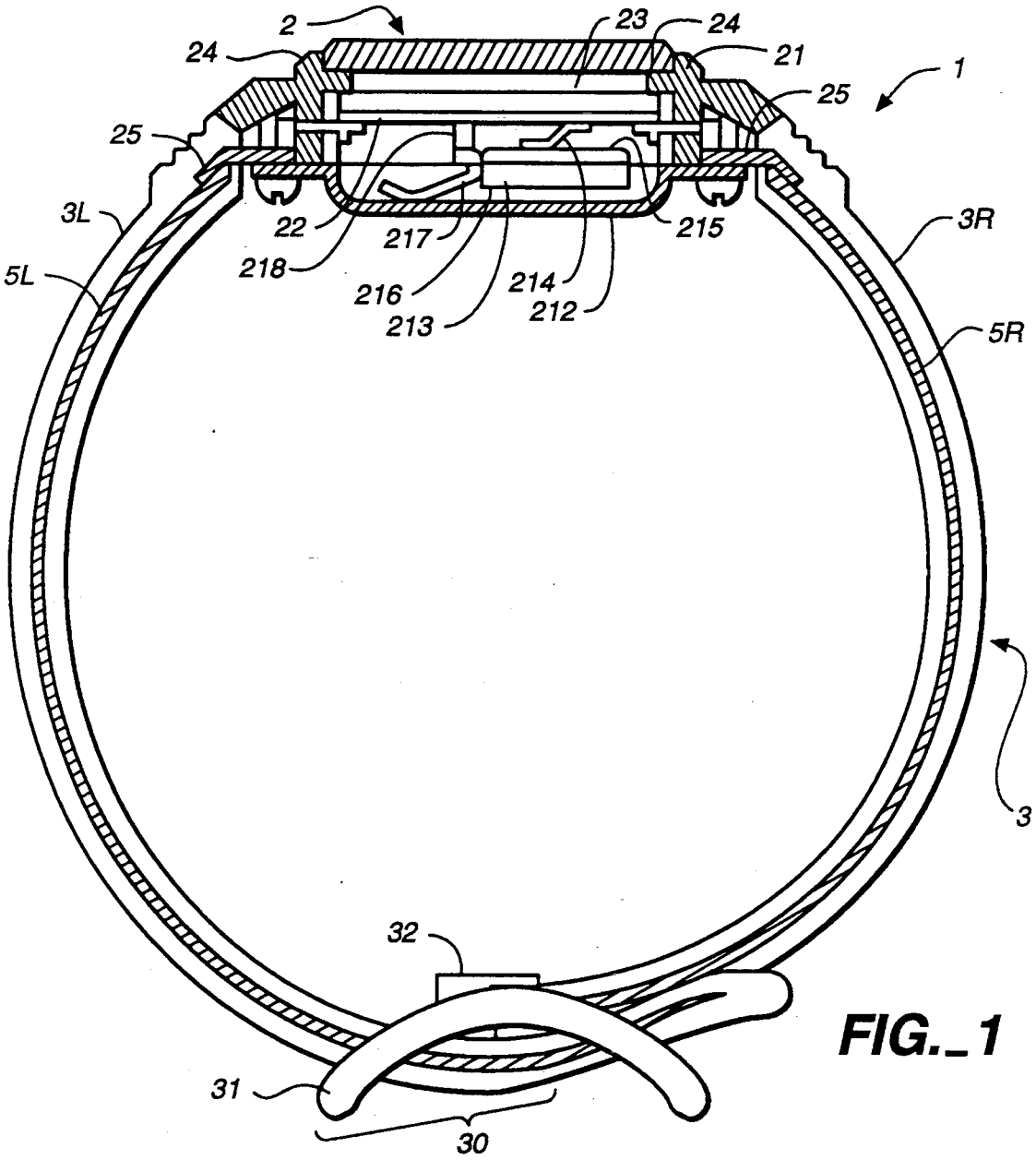
FIG. 1 shows the construction of an arm-attached type radio apparatus according to Embodiment 1 of the present invention.
Figure 2:
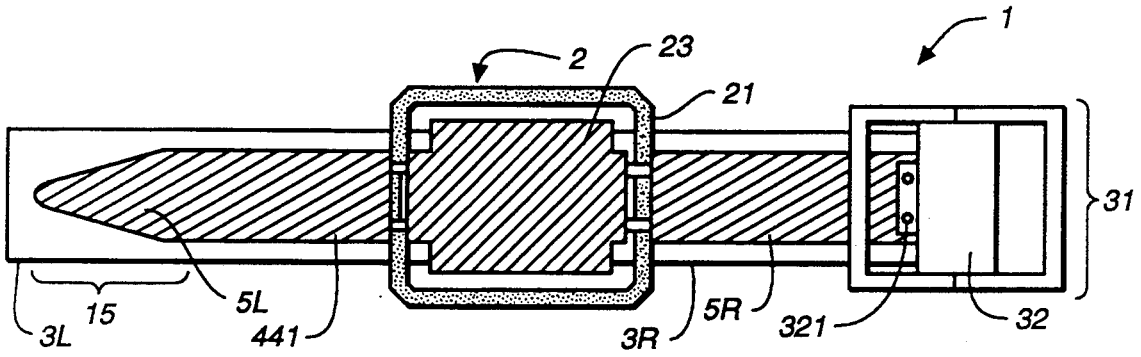
FIG. 2 is a cross-sectional view of the apparatus shown in FIG. 1.
Figure 3:
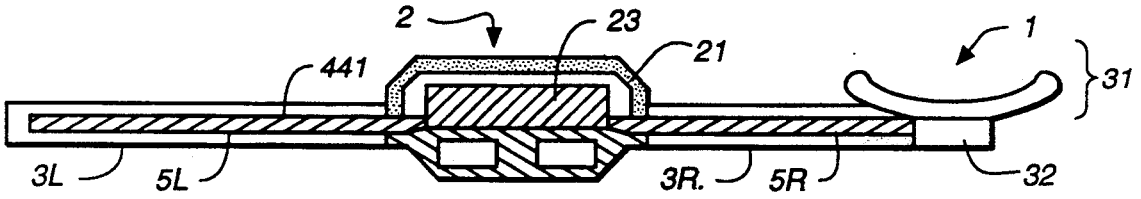
FIG. 3 is longitudinal section of the apparatus of FIG. 1.

Referring to FIGS. 1–3, a first embodiment of the present invention is shown wherein an arm band type radio apparatus 1 includes: a receiver body 2 having a circuit board 22 and a circuit block 23 (receiver circuit block) for the radio apparatus within a casing 21; a band 3 for attachment to an arm, having a first and second band members 3L, 3R formed of materials such as leather, silicone resin or urethane resin, connected to the sides of the receiver body. A metallic buckle (i.e., band connector) 31 is attached to the end portion of second band member 3R, and buckle 31 forms a band connector portion 30 by which the free end of first band member 3L is connected to the end of second band member 3R.

Figure 4:
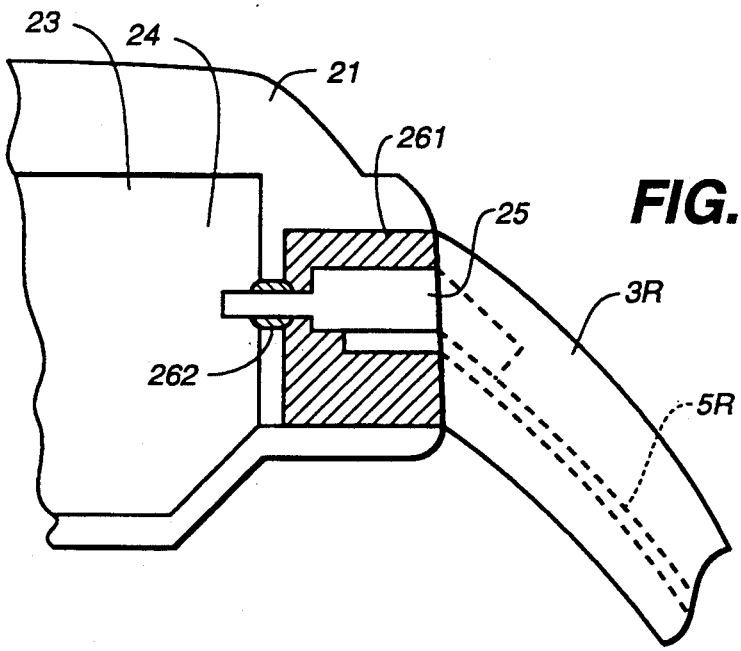
FIG. 4 is a longitudinal section of a portion around the case body of the apparatus of FIG. 1.
Figure 6:
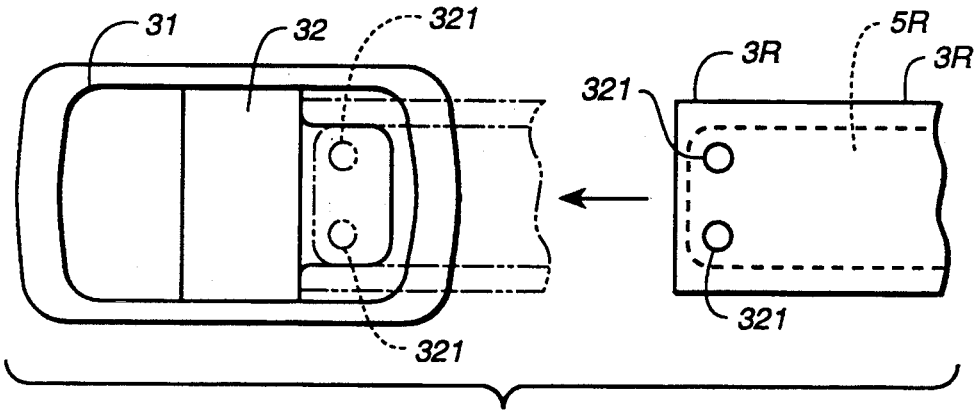
FIG. 6 is an exploded view of buckle shown in FIG. 5.
Figure 7:
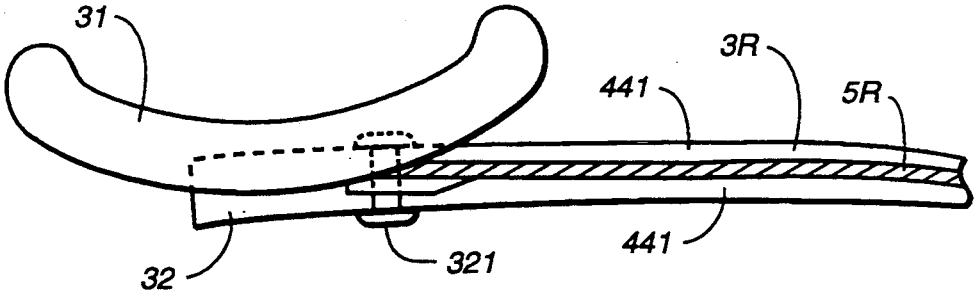
FIG. 7 is a side view of buckle shown in FIG. 5.

First and second band members 3L, 3R are formed by sewing together insulating sheets of material such as leather, silicone resin or urethane resin or by bonding them together. First and second conductor plates 5L, 5R are fixed inside band members 3L, 3R, respectively. FIG. 1 shows first and second band members 3L, 3R connected to each other by means of buckle 31. In this way, first and second band members 3L, 3R form a loop. First and second conductor plates 5L, 5R are electrically connected to the sides of receiver body 2. Circuit board 22 and circuit block 23 are disposed inside casing 21. Antenna input terminals 24 are electrically connected to the pattern of circuit board 22 by such means as soldering. Penetrating conductors 25 penetrate casing 21 as shown in FIG. 4 to make electrical connection with antenna input terminals 24. First and second conductor plates 5L, 5R are electrically connected to penetrating conductors 25. Insulating members 261, 262 make an airtight insulating seal around penetrating conductors 25. As shown in FIG. 1, a battery 213 for supplying power is placed at the interior of casing 21 between a back lid 212 and circuit board 22. Battery 213 is provided with an electrode plate 214 for making connection to negative electrode 215 and an electrode plate 217 for making connection to positive electrode 216. Electrode plate 217 is urged toward positive electrode 216 by a coil spring 218.

Figure 5:
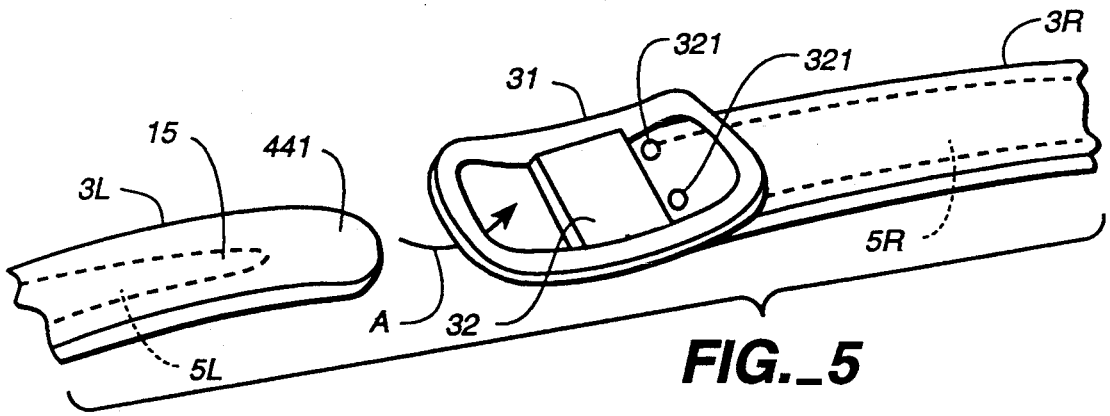
FIG. 5 shows a portion around the buckle of the apparatus of FIG. 1.
Figure 8:
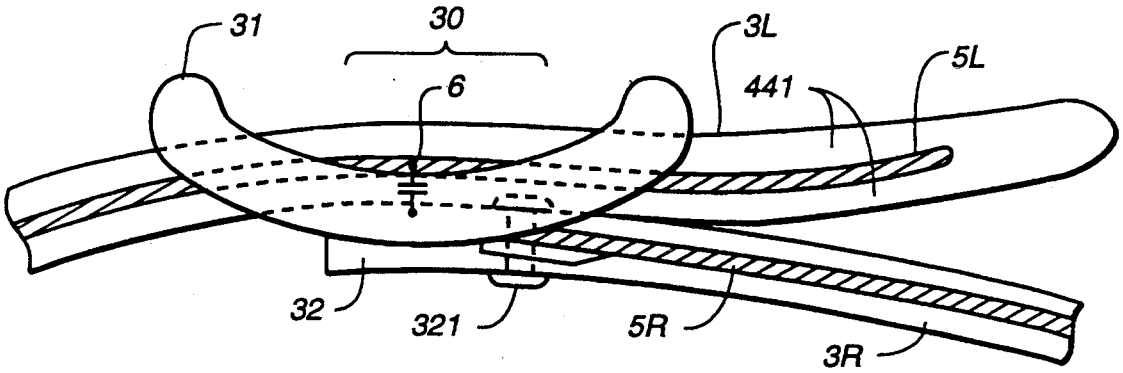
FIG. 8 shows the band members connected by the buckle.

As shown in FIGS. 1–8, a metallic buckle 31 is fixed by means of screws 321 to the free end side of second band member 3R and a metallic electrode plate 32 is integrally formed on buckle 31. Metallic electrode plate 32 is conductively connected via screws 321 to second band member 3R. When, as shown in FIG. 5, the free end of first band member 3L is put through buckle 31 along arrow A, first and second band members 3L, 3R are connected to each other at band connector portion 30. At the same time, as shown in FIG. 8, metallic electrode plate 32 contacts with its surface to first band member 3L, whereby metallic electrode plate 32 is brought into a state where it opposes first conductor plate 5L via a resin layer 441 of first band member 3L. Since resin layer 441 functions as a dielectric layer, a capacitor 6 is formed between metallic electrode plate 32 and first conductor plate 5L. In other words, as shown in FIG. 1, when arm attaching band 3 is formed into a loop by connecting first and second band members 3L, 3R by means of buckle 31, first and second conductor plates 5L, 5R are also formed into a loop. While being conductively connected to the sides of receiver body 2, first and second conductor plates 5L, 5R form an antenna 5 having capacitor 6 placed between first and second conductor plates 5L, 5R at band connector portion 30.

Figure 9A:
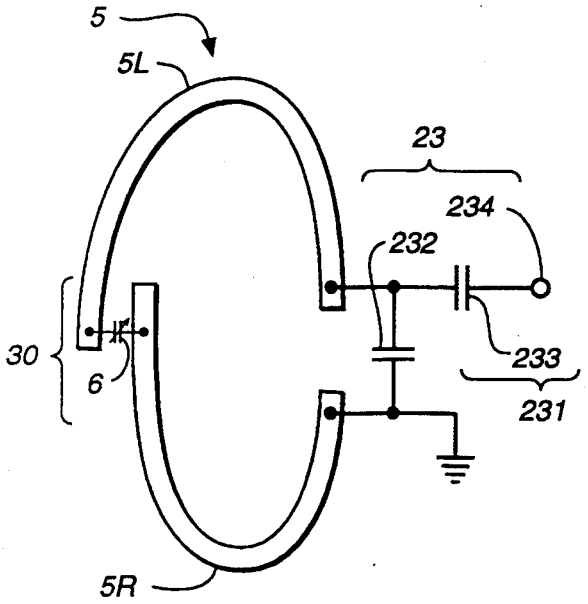
FIG. 9A is a block diagram of the antenna portion of the apparatus shown in FIG. 1; and 9B is an equivalent circuit diagram.
Figure 9B:
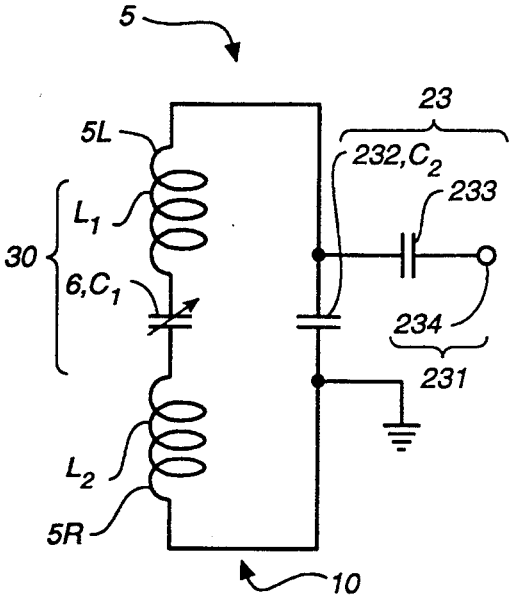

A block diagram of antenna 5 and its equivalent circuit are shown in FIGS. 9A–9B In antenna circuit 10, having capacitor 6 at band connector portion 30, antenna 5 is connected at the side of receiver body 2 to a receiver circuit 231 (circuit block 23 for the radio). First and second conductor plates 5L, 5R are represented by inductors $L_1$, $L_2$. Inductors $L_1$, $L_2$ and capacitor 6 are serially connected. Note that, in FIGS. 9A–B, antenna 5 is serially connected to a variable capacitor 232 of receiver circuit 231. Variable capacitor 232 is used in adjusting the resonance frequency by changing its capacitance. Further, while a terminal 234 for connection to a high-frequency circuit is connected via a coupling capacitor 233 to one side (first conductor plate 5L) of antenna 5, the other side (second conductor plate 5R) of antenna 5 is grounded to form receiver circuit 231 of an unbalanced circuit system.

Figure 10A:
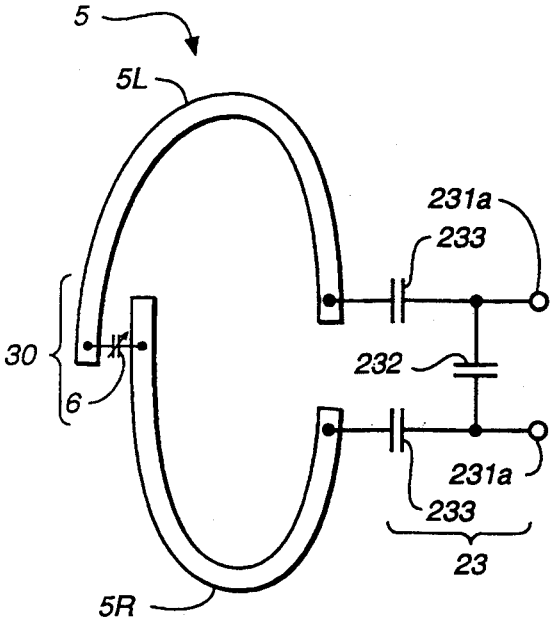
FIG. 10A is a block diagram of another antenna device embodiment; and (b) is an equivalent circuit diagram.
Figure 10B:
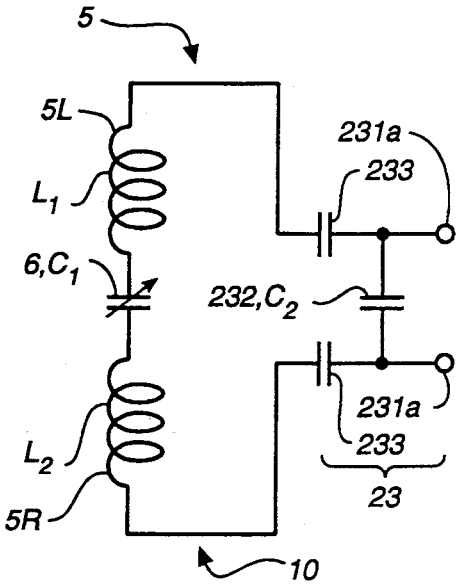
Figure 11:
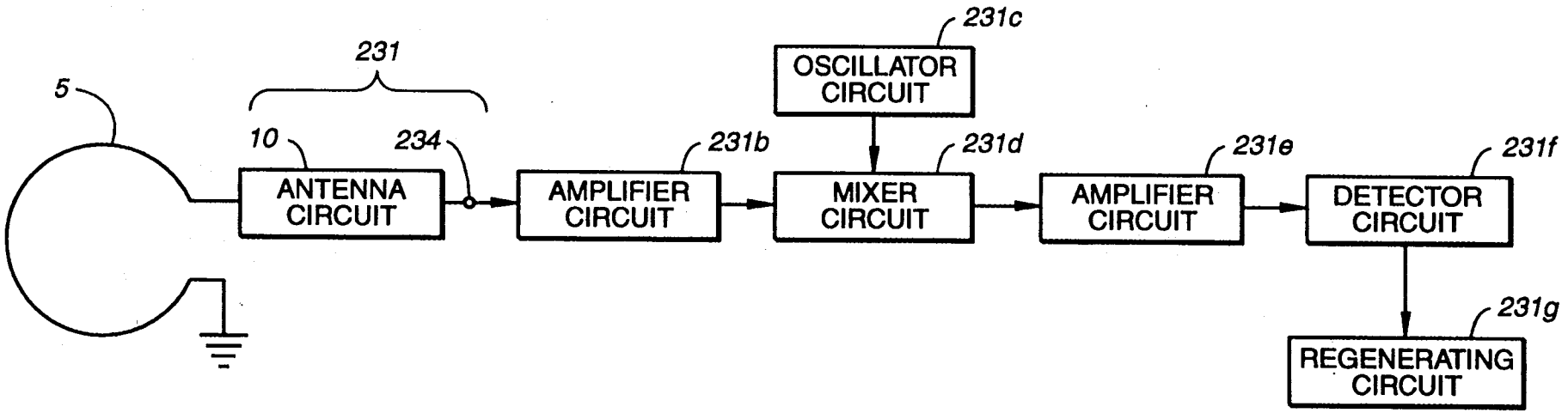
FIG. 11 is a circuit block diagram.

Referring to FIG. 2, at the side of first band member 3L, the end portion of first conductor plate 5L (serving as one of the electrodes of capacitor 6) forms an area changing portion 15 which tapers off toward the terminal end thereof. At the side of second band member 3R, metallic electrode plate 32 is provided, which serves as the other electrode of capacitor 6. Metallic electrode plate 32 is invariable in its area and has a sufficient width. Thus, when a wearer with a slender arm uses this, first conductor plate 5L is mechanically engaged with buckle 31 at a position toward casing 21 from the free end thereof. That is, since metallic electrode 32 opposes a region having a relatively large width of first conductor plate 5L, capacitance $C_1$ of capacitor 6 is relatively large. But, when this is used by a user having a thick arm, first conductor plate 5L is mechanically engaged with buckle 31 at a position toward the free end thereof. That is, since metallic electrode plate 32 opposes a region having a relatively narrow width of first conductor plate 5L, capacitance $C_1$ of capacitor 6 becomes smaller. First conductor plate 5L having such area changing portion 15 is used to form a resonance frequency compensation structure for compensating the shift in resonance frequency f. The connection method of receiver circuit 231 to antenna 5 may also be set as a balanced circuit system by connecting receiver circuit 231, as shown in FIGS. 10A–B, to both terminals (first and second conductor plates 5L, 5R) of variable capacitor 232. As shown by FIG. 11, receiver circuit 231 includes: a high-frequency amplifier circuit **231*b* connected to terminal 234, for amplifying signals passed through antenna circuit 10; a mixer circuit 231*d* for mixing the signal passed through high-frequency amplifier circuit 231*b* and the signal from a local oscillator circuit 231*c* to convert them to an intermediate frequency; an intermediate-frequency amplifier circuit 231*e* for amplifying the intermediate frequency; a detector circuit 231*f* for detecting the amplified intermediate-frequency signal; and a regenerating circuit 231*g* for regenerating the demodulated signal detected at detector circuit 231*f***.

In radio apparatus 1, resonance frequency f of antenna circuit 10 as shown in FIG. 9B is defined, in Eq. (1), by inductance $L_1$ of first conductor plate 5L, inductance $L_2$ of second conductor plate 5R, and composite capacitance $C_t$ of capacitor 6 and capacitance and variable capacitor 232.

$$f = \frac{1}{2\pi \cdot [(L_1 + L_2) \cdot C_t]^{\frac{1}{2}}} \qquad \text{Eq. (1)}$$

where $$\frac{1}{C_t} = \frac{1}{C_1} + \frac{1}{C_2} \qquad \text{Eq. (2)}$$

Thus, in order to keep a constant resonance frequency f, it suffices to maintain the relationship between inductance and capacitance indicated in Eq. (1). This is expressly shown in Eq. (3).

$$(L_1+L_2)\cdot C_t = \text{Constant} \qquad \text{Eq.(3)}$$

Here, inductances $L_1$ and $L_2$ are connected in a manner of high-frequency to each other via buckle 31, where they may be regarded as a single inductance (antenna inductance) and such antenna inductance $L_t$ may be expressed by Eq. (4)

$$L_t = (L_1+L_2) = K\cdot\mu_0\cdot S\cdot N^2/M \qquad \text{Eq.(4)}$$

where:

K is Nagaoka coefficient (see Appendix II); $\mu_0$ is permeability in a vacuum; S is the loop area of antenna 5 when first and second band members 3L, 3R are connected via buckle 31; N is the number of turns of antenna 5; and M is the width of antenna 5.

The loop area S of antenna 5 may be represented by Eq. 5 when assuming the opening portion thereof as circular and its radius as "a".

$$S = \pi\cdot a^2 \qquad \text{Eq.(5)}$$

If the loop length, a, of antenna 5 becomes shorter, then opening area Sa may be expressed by Eq. (6) if the amount by which it is shortened is $\Delta\alpha$.

$$S_a = \pi \cdot \left(a - \frac{\Delta\alpha}{2\pi}\right)^2 \qquad \text{Eq. (6)}$$

Therefore, by substituting Eq. (6) into Eq. (4), a ratio $\Delta L_t$ of the antenna inductances $L_t$ before shortening and after shortening of antenna 5 may be expressed by Eq. (7).

$$\Delta L_t = \left(a - \frac{\Delta\alpha}{2\pi}\right)^2 / a^2 \qquad \text{Eq. (7)}$$

As indicated by Eq. (7), as $\Delta\alpha$ becomes larger (i.e., loop length of the antenna becomes shorter), $\Delta L_t$ becomes smaller than 1. That is, the value of the antenna inductance becomes smaller compared to the case where the loop length of antenna 5 is not changed ($\Delta\alpha=0$). On the other hand, when the loop length of antenna 5 becomes longer ($\Delta\alpha<0$), the value of the antenna inductance $L_t$ becomes larger. Accordingly, in order to keep resonance frequency f at a constant, it is necessary to increase the composite capacitance $C_t$ when $\Delta\alpha$ is larger (the loop length of antenna 5 is made shorter) in Eq. (3), since the value of the antenna inductance becomes smaller. On the other hand, when $\Delta\alpha$ becomes smaller to be negative by passing zero (the loop length of antenna 5 becomes longer), it is necessary to make smaller the composite capacitance $C_t$, since the value of the antenna inductance $L_t$ becomes larger.

Eq. (8) defines the capacitance $C_1$ of capacitor 6 as:

$$C_1 = \epsilon \cdot \frac{A}{d} \qquad \text{Eq. (8)}$$

where $\epsilon$ is the dielectric constant of the material between metallic electrode plate 32 and first conductor plate 5L; A is the overlap area between opposing metallic electrode plate 32 and first conductor plate 5L; and d is the distance between metallic electrode plate 32 and first conductor plate 5L.

Note that, if $C_1 << C_2$, antenna capacitance $C_t$ may be approximated, as shown by Eq. (9), to be $C_1$ $$C_t = C_1 \qquad \text{Eq.(9)}$$

In order to compensate for the shift in resonance frequency f, it is necessary, as shown by Eqs. (3) and (4) to make the product of antenna inductance $L_t$ and composite capacitance $C_t$ a constant. That is, it suffices to compensate for the value of ratio $\Delta L_t$ of the change in the antenna inductance by ratio $\Delta C_t$ of composite capacitance $C_t$. This condition is represented by modifying Eq. (3) to obtain Eqs. (10) and (11).

$$L_r \Delta L_r C_r \Delta C_t = \text{a constant} \qquad \text{Eq.(10)}$$

$$\Delta L_r \Delta C_t = 1 \qquad \text{Eq.(11)}$$

From Eqs. (7) and (11), the condition for compensating resonance frequency f is that the ratio of change in the ratio $\Delta C_t$ of composite capacitance $C_t$ follows Eq. 12.

$$\Delta C_t = \frac{a2}{\left(a - \frac{\Delta\alpha}{2\pi}\right)^2} \qquad \text{Eq. (12)}$$

If Eq. (9) holds, the value of $\Delta C_t$ may be replaced by the changing amount of the area A of overlap capacitance $C_1$ as seen from Eqs. (8) and (9). That is, Eq. (12) is modified by assuming the area A as a function of $\Delta\alpha$ to obtain Eq. 13.

$$A(\Delta\alpha) = \beta \cdot \frac{a2}{\left(a - \frac{\Delta\alpha}{2\pi}\right)^2} \qquad \text{Eq. (13)}$$

where $\beta$ is the area when $\Delta\alpha=0$. Thus, when the loop length of antenna 5 becomes shorter ($\Delta\alpha>0$ and its absolute value is in the increasing direction), the value of $A(\Delta\alpha)$ is increased to increase the value of capacitance $C_1$ of capacitor 6, whereby the effect over the resonance frequency caused by a change in the antenna inductance is compensated for.

Thus, in radio apparatus 1, a shape satisfying Eq. (13), i.e., an area changing portion 15 tapering off toward the terminal end thereof is provided, as shown in FIG. 2, on the side of first band member 3L, for the end portion, of first conductor plate 5L.

Figure 12A:
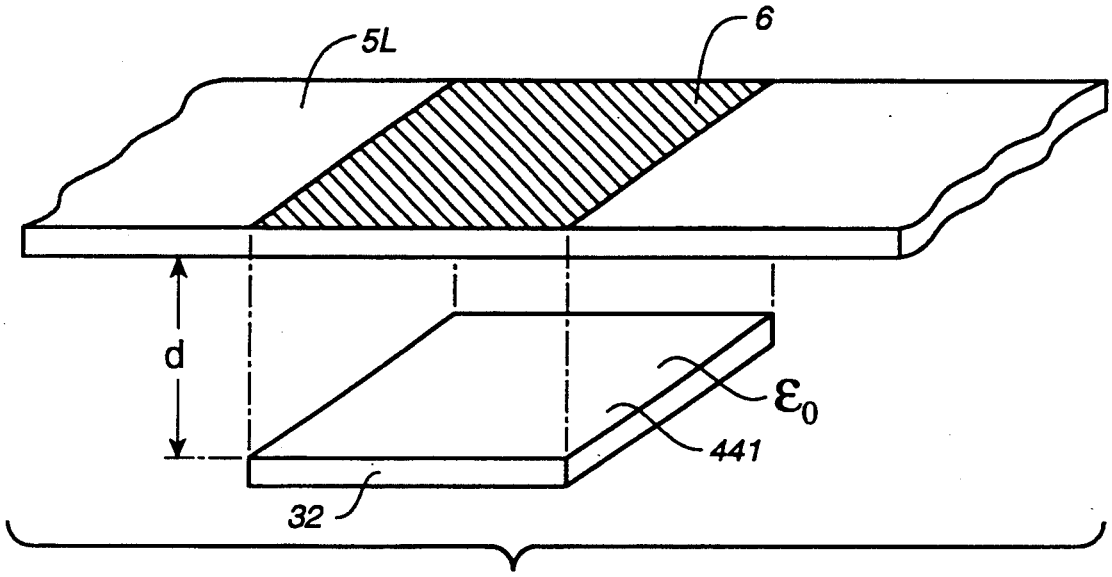
FIG. 12A shows an overlap capacitor; and (b) shows an overlap capacitor in another state.
Figure 12B:
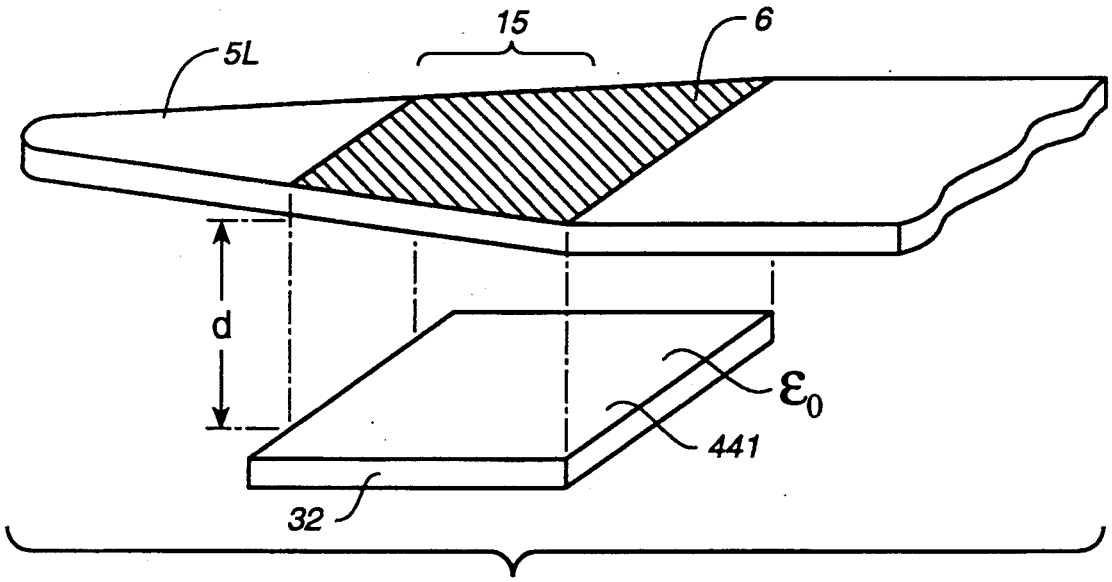

To illustrate, take as the reference state the condition in which metallic electrode 32 opposes a region having a relatively large width of first conductor plate 5L as shown in FIG. 12A. When the state is changed to the one shown in FIG. 12B where metallic electrode plate 32 opposes the terminal end side (a region with a relatively narrow width) of first conductor plate 5L, while a shift occurs to increase the value of antenna inductance $L_t$, the opposing area between first conductor plate 5L and metallic electrode plate 32 is reduced thereby decreasing capacitance $C_1$. Since the amount of reduction (ratio $\Delta C_t$ of change) of the composite capacitance $C_t$ corresponds to satisfy Eq. (11) with respect to the change (ratio $\Delta L_t$) of antenna inductance $L_t$, the effect on resonance frequency f by antenna inductance $L_t$ is compensated.

Figure 13A:
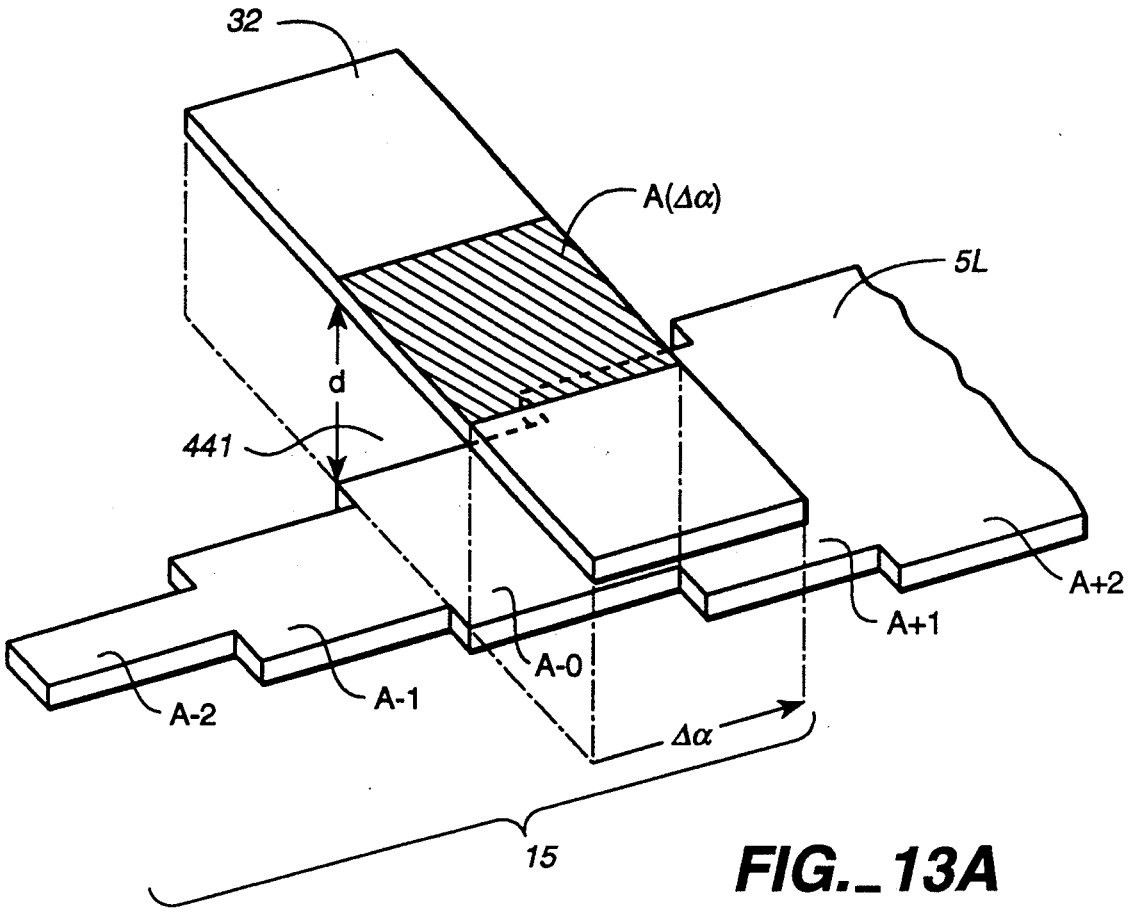
FIG. 13A shows that the overlap capacitor of the apparatus shown in FIG. 1 changes; and (b) shows the shape of the conductor plate for achieving such change.
Figure 13B:
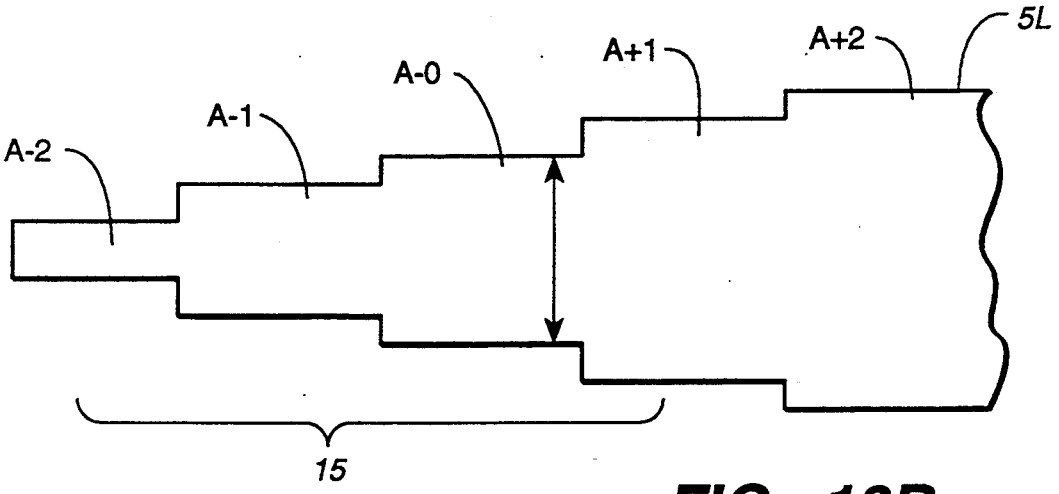

An example of the result of such computation will now be described first with respect to a case where capacitance $C_2$ of variable capacitor 232 is relatively large, e.g., 1000 pF, so that its effect over the composite capacitance $C_t$ may be ignored. In order to facilitate the way of handling area changing portion 15 in the computation, it is regarded, as shown in FIGS. 13A–B, as a shape wherein its width is narrowed in a step-like manner toward its terminal end. A change in its width occurs every 10 mm in the length direction. Further, the opposing position of metallic electrode plate 32 with respect to first conductor plate 5L is displaced by 10 mm at a time from the state shown in FIG. 13A. Note that the width at the reference region A−0 of first conductor plate 5L is 7 mm; the opposing distance between metallic electrode plate 32 and first conductor plate 5L, i.e., the thickness of resin layer 441 of first band member 3L placed between metallic electrode plate 32 and first conductor plate 5L is $1.8\times10^{-3}$ m, $1.8\times10^{-4}$ m, or $1.6\times10^{-5}$ m; and the dielectric constant $\epsilon_r$ of such material when the dielectric of air is set to 1 is 3. The thickness of resin layer 441 being $1.8\times10_{-3}$ m is the condition for setting capacitance $C_1$ of capacitor 6 at the reference region A−0 to about 1 pF; the condition of the thickness being $1.8\times10_{-4}$ m is the condition for setting capacitance $C_1$ at the reference region A−0 to about 10 pF; and the condition of the thickness being $1.6\times10_{-5}$ m is the condition for setting capacitance $C_1$ at the reference region A−0 to about 100 pF. When the dielectric constant $\epsilon_r$ of first band member 3L is 5, the above condition setting corresponds to the case where the thickness is $3\times10^{-3}$ m, $3\times10^{-4}$ m, or $2.7\times10^{-5}$ m, respectively. Under this condition, if the wearer's arm is relatively thick, metallic electrode plate 32 is slid from the state as shown in FIG. 13A by 10 mm at a time toward regions A−1, A−2 on the terminal end side of first conductor plate 5L to reduce the opposing area A ($\Delta\alpha$). On the other hand, if the wearer's arm is slender, metallic electrode plate 32 is slid by 10 mm at a time toward regions A+1, A+2 on the base end side of first conductor plate 5L to increase the opposing area A ($\Delta\alpha$). The result of computation for the width of each of the regions A−2-~A+2 of area changing portion 15 by which the change in the antenna inductance $L_t$ at that time may be compensated is shown in Table 1.

TABLE 1

Unit (mm)

| | Opposing region of First Conductor Plate 5L | | | | |
|---|---|---|---|---|---|
| | Terminal end side | Reference position | | Base end side | |
| | A-2 | A-1 | A-0 | A + 1 | A + 2 |
| $d = 1.8 \times 10^{-3}$ m | 5.44 | 6.19 | 7.00 | 7.96 | 9.00 |
| $d = 1.8 \times 10^{-4}$ m | 5.43 | 6.19 | 7.00 | 7.97 | 9.02 |
| $d = 1.6 \times 10^{-5}$ m | 5.30 | 6.12 | 7.00 | 8.08 | 9.27 |

A description will now be given with respect to a case where capacitance $C_2$ of capacitance 232 is taken to be 8 pF, for example, and its effect over the composite capacitance $C_t$ cannot be ignored. In this case, since it is necessary to include capacitance $C_2$ of variable capacitor 232 in the calculation, the computation formula may be expressed as:

$$C_1(\Delta\alpha) = \frac{C_2 \cdot (\epsilon/d) \cdot A(\Delta\alpha)}{C_2 - [(\epsilon/d) \cdot A(\Delta\alpha)]} \qquad \text{Eq. (14)}$$

$$= -C_2 + \frac{C_2^2}{C_2 - \left[(\epsilon/d) \cdot \beta \cdot \left(1 + \frac{\Delta\alpha}{\alpha - \Delta\alpha}\right)\right]}$$

In this case too, in order to facilitate the handling of first conductor plate 5L in the computation, it is assumed that, of first conductor plate 5L, the width of area changing portion 15 is narrowed as shown in FIGS. 13A-B toward the terminal end thereof. The state shown in FIG. 13A is regarded as the reference. From this state, in a similar manner as in the above-described computation, metallic electrode plate 32 is slid by 10 mm at a time toward regions A−1, A−2 or toward regions A+1, A+2. The result of computation of the width of each of the regions A−2~A+2 by which the accompanying change in the antenna inductance $L_t$ may be compensated for is shown in Table 2. Note that the dielectric constant $\epsilon_r$ of first band member 3L is 3, and the thickness of resin layer 441 is $2.0\times10^{-3}$ m, $9.2\times10^{-4}$ m, $4.6\times10^{-4}$m, $2.3\times10^{-4}$ m or $1.16\times10^{-4}$ m. These are the conditions for setting the composite capacitance $C_t$ at the reference state to 0.8 pF, 1.6 pF, 2.6 pF, 4.0 pF or 5.3 pF, respectively. Further, these conditions corresponds to the case where the thickness is $3.4\times10^{-3}$ m, $1.5\times10^{-4}$ m, $7.7\times10^{-4}$ m, $3.8\times10^{-4}$m, and $1.9\times10^{-4}$m when the dielectric constant $\epsilon_r$ is 5.

TABLE 2

Unit (mm)

| | Overlapping area of First Conductor Plate 5L | | | | |
|---|---|---|---|---|---|
| | Terminal end side | Reference position | | Base end side | |
| | A-2 | A-1 | A-0 | A + 1 | A + 2 |
| $d = 2.0 \times 10^{-3}$ m | 5.30 | 6.12 | 7.00 | 8.08 | 9.27 |
| $d = 9.2 \times 10^{-4}$ m | 5.13 | 6.02 | 7.00 | 8.24 | 9.65 |
| $d = 4.6 \times 10^{-5}$ m | 4.83 | 5.86 | 7.00 | 8.55 | 10.38 |
| $d = 2.3 \times 10^{-4}$ m | 4.31 | 5.56 | 7.00 | 9.23 | 12.22 |
| $d = 1.16 \times 10^{-4}$ m | 3.45 | 5.04 | 7.00 | 10.99 | 19.0 |

In radio apparatus 1, first and second conductor plates 5L, 5R form a loop-like antenna 5 wherein first and second band members 3L, 3R are connected to each other by means of buckle 31. Since the loop length of antenna 5 changes according to the thickness of a wearer's arm, the inductance value (L) of the antenna varies. However, radio apparatus 1 is constructed such that the shift in resonance frequency f, caused by a change in the loop length of antenna 5, is compensated for by changing overlap capacitance $C_1$. That is, as the opposing area of first conductor plate 5L changes on the basis of the change in the loop length of antenna 5, the product of antenna inductance L and composite capacitance $C_t(C_t=C_1+C_2)$, which defines resonance frequency f, is a constant. Thus, even if the loop length is changed, resonance frequency f does not change. Therefore, a stable antenna gain is obtained without being affected by changes in loop length.

Modification of Embodiment 1

Figure 14A:
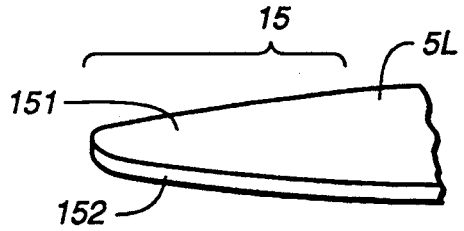
FIGS. 14A–F each show another structure of the conductor plate for making possible a change in the magnitude of the overlap capacitance.
Figure 14B:
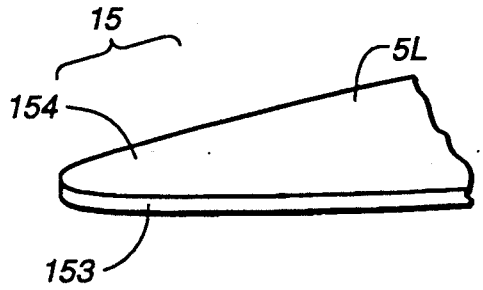
Figure 14C:
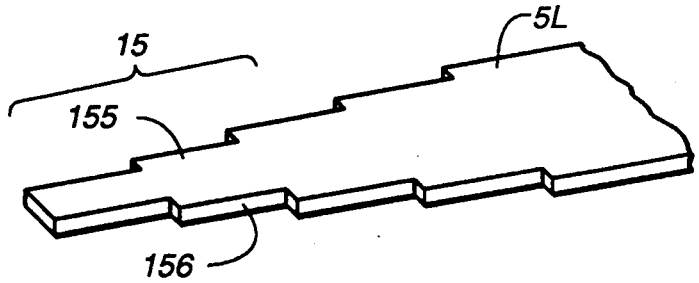
Figure 14D:
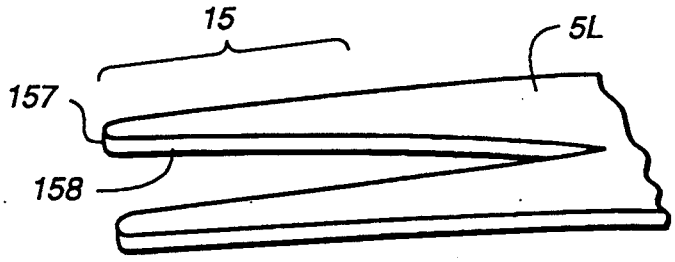
Figure 14E:
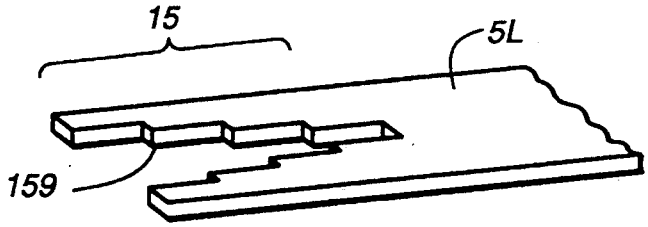
Figure 14F:
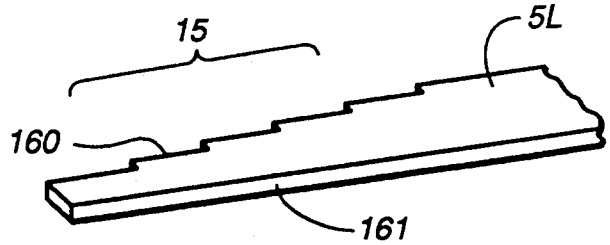

As shown in FIG. 14A, in Embodiment 1, the shape of area changing portion 15 of first conductor plate 5L is such that two sides 151, 152, are shaped, into curves and its width is narrowed toward its terminal end. Alternatively, as shown in FIG. 14B, its shape may be such that, a side 153, forms a straight line and only another side 154, comprises a curvilinear shape so that its width is narrowed toward its terminal end. In addition, its shape may also be: 1) as shown in FIG. 14C where both of its sides 155, 156 comprise step-like curvilinear shape and its width is narrowed by steps toward the terminal end edge thereof; 2) as shown in FIG. 14D having a notch 158 cut into from the center portion of an terminal end edge 157 thereof; 3) as shown in FIG. 14E where a notch 159 thereof is formed into a stepped mariner; or 4) as shown in FIG. 14F where one side 160 thereof is a straight line and only another side 161 comprises steps. Further, its shape may also be such that the opposing area thereof against metallic electrode plate 32 is varied by intermittently forming, for example, holes on conductor plate 5L.

Embodiment 2

Figure 15A:
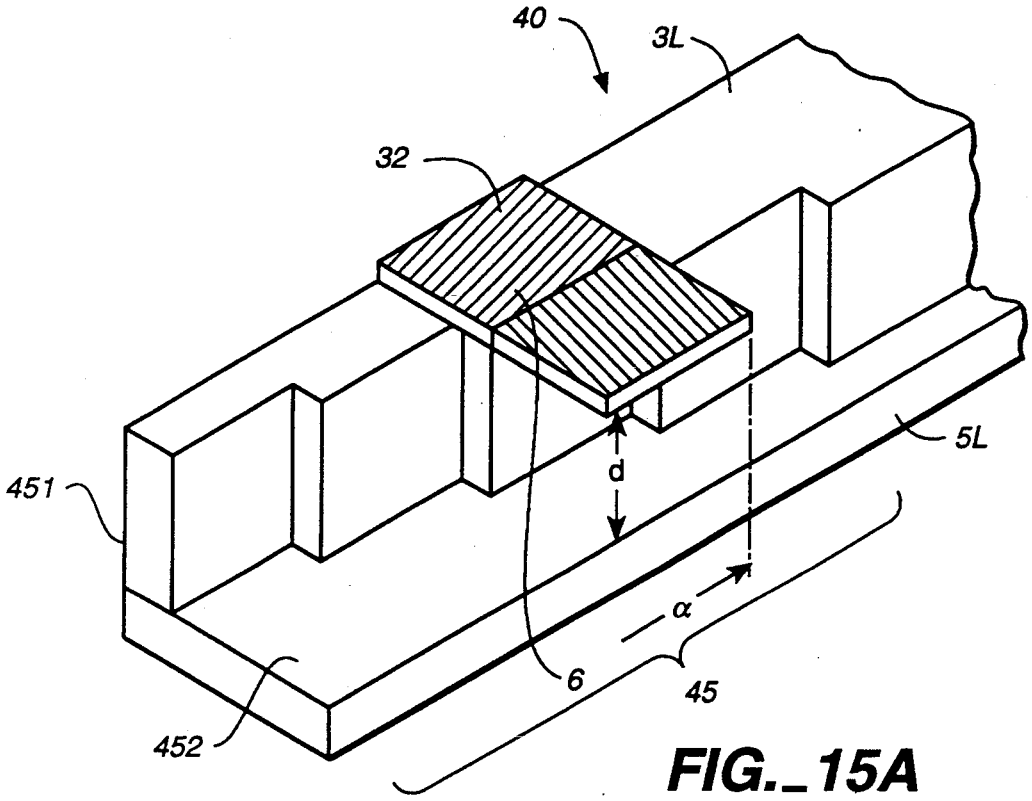
FIGS. 15A–B illustrate a second embodiment wherein overlap capacitance is a function of the relative positions of conductor plate and band.
Figure 15B:
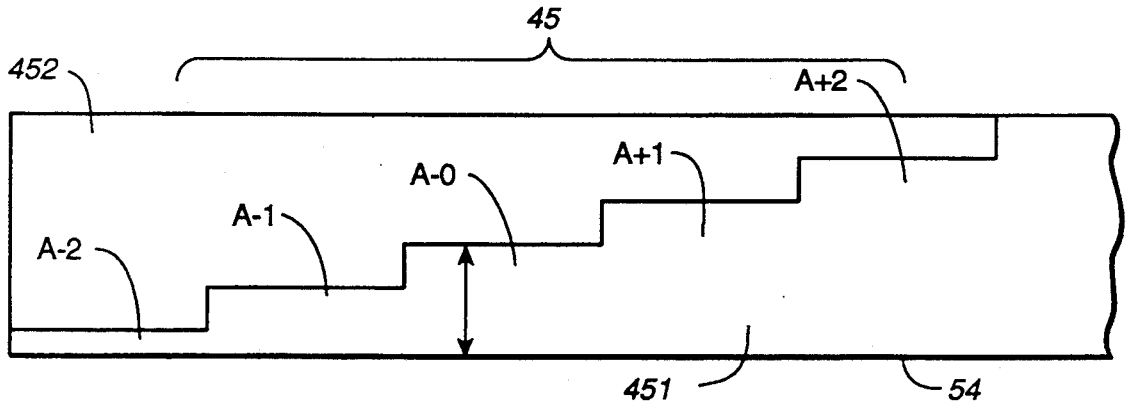

FIG. 15A shows the construction of the terminal end of a first band member of an antenna device for an arm-attached type radio apparatus according to Embodiment 2 of the present invention. Since the construction of this arm-attached type radio apparatus is similar to that of the arm-attached type; radio apparatus according to Embodiment 1 (with the exception of the resonance frequency compensation means at the terminal end side of the first band member thereof), the same reference numerals are given to those components having corresponding functions.

In radio apparatus 40, in a similar manner as the arm-attached type radio apparatus according to Embodiment 1 as shown in FIG. 1, its overall construction includes: a receiver body 2 having within a casing 21 a circuit board 22 and circuit block 23 for radio apparatus; and an arm attaching band 3 having a first and second band members 3L, 3R connected to receiver body 2. Of the arm attaching band 3, the end portion of second band member 3R has a band connector portion 30 thereon formed of a metallic buckle 31 attached thereto. Buckle 31 is operable to detachably connect band members 3L, 3R. Band members 3L, 3R can be made from materials such as leather, silicone resin or urethane resin. First and second band members 3L, 3R respectively have first and second conductor plates 5L, 5R formed therein. By connecting band members 3L, 3R a loop-like antenna 5 is formed.

Referring to FIGS. 1, 9A and 15A, antenna 5, at band connector portion 30, has a capacitor 6 formed between a metallic electrode plate 32 formed integrally with buckle 31 and first conductor plate 5L on the side of first band member 3L which is mechanically engaged with buckle 31. Thus, as shown in FIGS. 9A–9B, 10A–10B, the construction of antenna 5 is such that capacitor 6 and a variable capacitor 232 are serially connected with respect to inductance $L_1$ of first conductor plate 5L and inductance $L_2$ of second conductor plate 5R.

In radio apparatus 40, as the loop length of antenna 5 changes according to the thickness of the wearer's arm, antenna inductance L (composed of inductance $L_1$ and inductance $L_2$) is changed and the antenna resonance frequency is therefore changed. Thus, in radio apparatus 40, a resonance frequency compensation means is provided, which compensates for the effect of antenna inductance L on resonance frequency f by changing capacitance $C_1$ of capacitor 6. As expressed by Eq. (8), capacitance $C_1$ is defined by opposing area A, dielectric constant E and electrode spacing d. While the width of first conductor plate 5L and the thickness of first band member 3L are kept constant, an effective-dielectric-constant changing portion 45 is provided on first band member 3L serving as the dielectric, where resin layer 451 of the band is partially missing and an air layer 452 exists. Capacitance $C_1$ is changed by changing the effective-dielectric-constant of capacitor 6 according to the connecting position on the free end side of arm attaching band 3. This is done to compensate for the effect of antenna inductance L on resonance frequency f. Thus, while opposing area A and electrode spacing are constant (because the width of first conductor plate 5L and the thickness of first band member 3L are constant), the ratio in which resin layer 451 and air layer 452 exist as the dielectric is varied according to the region thereof between metallic electrode plate 32 and first conductor plate 5L. As a result, the actual capacitance $C_1$ of capacitor 6 is expressed by Eq. (14) as it is regarded as the sum of capacitance $C_{a1}$ which is attributable to the capacitance component which is formed at the portion where resin layer 451 exists and capacitance $C_{b2}$ which is attributable to the capacitance component which is formed at the position where air layer 452 exists.

$$C_1 = C_{a1} + C_{b1} = \epsilon_1 \cdot \frac{A_1}{d} + \epsilon_2 \cdot \frac{A_2}{d} \qquad \text{Eq. (15)}$$

where:

$\epsilon_1$ is the dielectric constant of resin layer 451; $\epsilon_2$ is the dielectric constant of the air layer; d is the thickness of resin layer 451; $A_1$ is the opposing area of first conductor plate 5L and metallic electrode plate 32 corresponding to the portion where resin layer 451 exists; and $A_2$ is the opposing area of first conductor plate 5L and metallic electrode plate 32 corresponding to the portion where resin layer 451 does not exist but air layer 452 exists.

Of thus expressed capacitances $C_{a1}$ and $C_{b1}$, since the dielectric constant $\epsilon_2$ of air layer 452 is extremely small compared to dielectric constant $\epsilon_1$ of resin layer 451 and the ratio of areas $A_1$, $A_2$ changes depending on the connecting position of arm attaching band 3, capacitance $C_1$ may be regarded as a function of the connecting position of arm attaching band 3. For example, supposing the state shown in FIG. 15A as the reference, when the length of antenna 5 has increased by $\Delta\alpha$ from this state, the ratio of the opposing area $A_1$ between first conductor plate 5L and metallic electrode plate 32 corresponding to the portion where resin layer 451 exists is reduced to make capacitance $C_1$ smaller. That is, since both antenna inductance L and capacitance $C_1$ are functions of $\Delta\alpha$, regarded as the shift amount from the reference position, the product of antenna inductance L and composite capacitance $C_t$ is kept constant even when the connecting position of arm attaching band 3 is changed by the thickness of the wearer's arm. As a result, capacitance $C_1$ compensates for the effect of a change in antenna inductance on resonance frequency f.

Here, the computation result with respect to the structure of effective-dielectric-constant changing portion 45 of first band member 3I, will be described. Note that, in this computation, a description is given with respect to the case where capacitance $C_2$ of variable capacitor 232 is taken to be 8 pF and its effect on composite capacitance $C_t$ cannot be ignored. In order to facilitate the handling of effective-dielectric-constant changing portion 45 in the computation, it is supposed that, at effective-dielectric-constant changing portion 45, the width of the portion at which resin layer 451 exists is narrowed as displaced by 10 mm toward the terminal end and the opposing position of metallic electrode plate 32 is displaced by 10 mm at a time from the state shown in FIG. 15A. Here, the width of first conductor plate 5L is 7 mm and the width of resin layer 451 is 3.5 mm. Note that it is set so that capacitance $C_1$ of capacitor 6 at the reference state shown in FIG. 15A is 2 pF, 8 pF. Of these, for the case of capacitance $C_1$ being 2 pF, the computation is performed with respect to the case where the opposing distance between metallic electrode plate 32 and first conductor plate 5L, is $1.7\times10^{-3}$ m, $9.2\times10^{-4}$m, or $6.1\times10^{-4}$m. For the case of capacitance $C_1$ being 0.8 pF, the computation is performed with respect to the case where the thickness of resin layer 451 is $4.26\times10^{-3}$ m, $2.3\times10^{-3}$ m, or $1.5\times10^{-3}$ m. Further, while the computation is performed with respect to the case where dielectric constant $\epsilon_r$ of resin layer 451 is 10, 5 or 3, the dielectric constant of the air layer is treated as 1. Under such condition, if the wearer's arm is relatively thick, metallic electrode plate 32 is slid from the state shown in FIG. 15A by 10 mm at a time toward regions A−1, A−2 on the terminal end side of first conductor plate 5L so as to reduce the dielectric constant $\epsilon$ thereof. If the wearer's arm is slender, metallic electrode plate 32 is slid by 10 mm at a time toward regions A+1, A+2 on the base end side of first conductor plate 5L so as to increase the dielectric constant $\epsilon$ thereof. The results of the computation for the width of resin layer 451 of each of regions A−2~A+2 at effective-dielectric-constant changing portion 45 are shown in Tables 3 and 4.

TABLE 3

When $C_t$ is 2.0pF — Unit (mm)

| | Opposing region of First Conductor Plate 5L | | | | |
|---|---|---|---|---|---|
| | Terminal end side | Reference position | | Base end side | |
| | A-2 | A-1 | A-0 | A + 1 | A + 2 |
| $e_r = 10$, $d = 1.7 \times 10^{-3}$ m | 2.43 | 2.90 | 3.50 | 4.26 | 5.27 |
| $e_r = 5$, $d = 9.2 \times 10^{-4}$ m | 2.19 | 2.77 | 3.50 | 4.43 | 5.67 |
| $e_r = 3$ | 1.75 | 2.52 | 3.50 | 4.74 | 6.40 |

TABLE 3-continued

| When $C_t$ is 2.0pF | Unit (mm) | | | | |
|---|---|---|---|---|---|
| | Opposing region of First Conductor Plate 5L | | | | |
| | Terminal end side | Reference position | | Base end side | |
| | A-2 | A-1 | A-0 | A + 1 | A + 2 |
| $d = 6.1 \times 10^{-4}$ m | | | | | |

where $\epsilon_r = \epsilon_1/\epsilon_2 = \epsilon_1/\epsilon_0$ ($\epsilon_0$ is dielectric constant in vacuum = dielectric constant of the air)

TABLE 4

| When $C_t$ is 0.8pF | | | | | |
|---|---|---|---|---|---|
| | Opposing region of First Conductor Plate 5L | | | | |
| | Terminal end side | Reference position | | Base end side | |
| | A-2 | A-1 | A-0 | A + 1 | A + 2 |
| $e_r = 10$ $d = 4.26 \times 10^{-3}$ m | 2.52 | 2.96 | 3.50 | 4.16 | 5.00 |
| $e_r = 5$ $d = 2.3 \times 10^{-3}$ m | 2.30 | 2.84 | 3.50 | 4.31 | 5.34 |
| $e_r = 3$ $d = 1.5 \times 10^{-3}$ m | 1.90 | 2.62 | 3.50 | 4.58 | 5.96 |

Unit (mm)

As has been described, in radio apparatus 40, both antenna inductance L and capacitance $C_1$ are functions of $\Delta\alpha$ as the amount of shift from the reference position depending on the connecting position of arm attaching band 3. Capacitance $C_1$ changes in correspondence to a change in antenna inductance L on the basis of the structure of effective-dielectric-constant changing portion 45 of first band member 3L. Thus, since the product of antenna inductance L and composite capacitance $C_t$ is a constant even when the connecting position of arm attaching band 3 is changed, capacitance $C_1$ can compensate for the effect of a change in antenna inductance L on resonance frequency f.

Modification of Embodiment 2

Figure 16A:
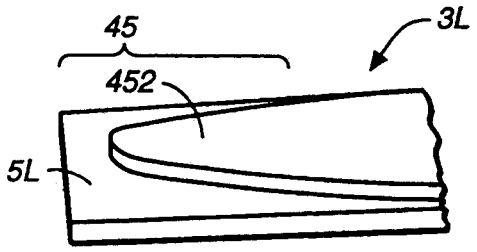
FIGS. 16A–F each show another structure of the conductor plate for making possible a change in the overlap capacitance.
Figure 16B:
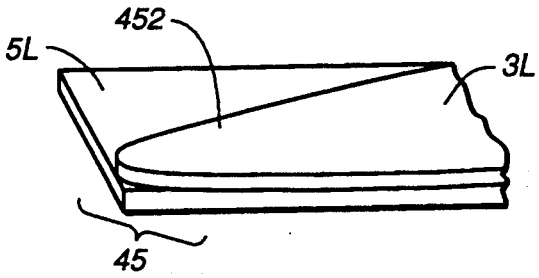
Figure 16C:
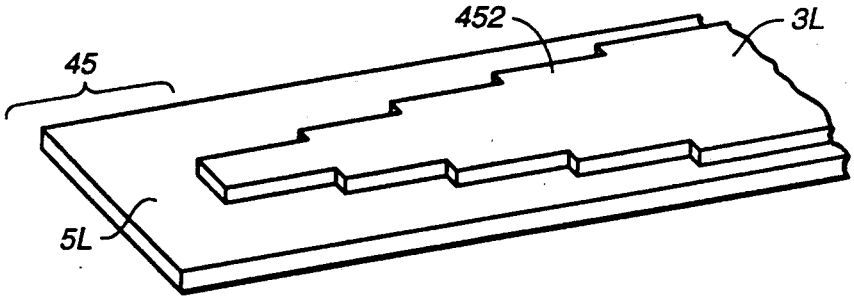
Figure 16D:
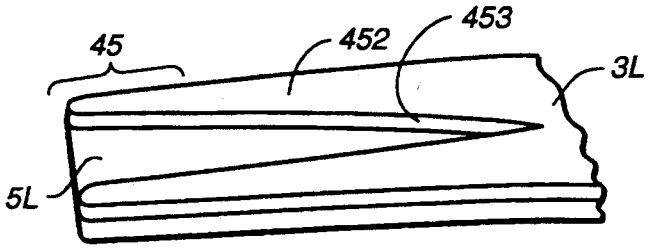
Figure 16E:
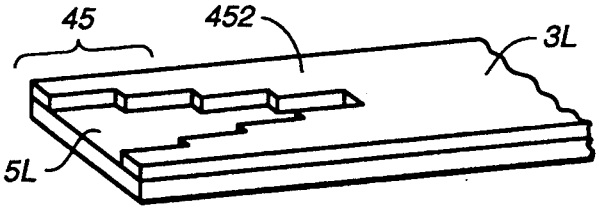
Figure 16F:
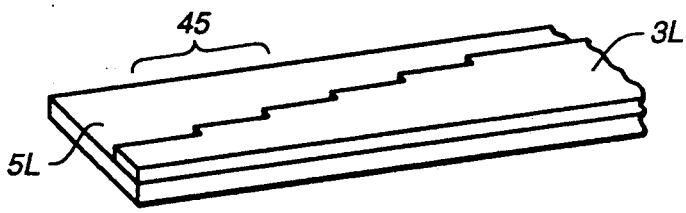

With respect to the structure of effective-dielectric-constant changing portion 45 of Embodiment 2, those which may be used instead of the structure as shown in FIG. 16F where the width of the portion at which first band member 3L exists is narrowed in steps toward the terminal end thereof include: 1) as shown in FIG. 16A where the width of resin layer 451 existing at the center region of first conductor plate 5L is gradually narrowed toward the terminal end thereof; 2) as shown in FIG. 16B where resin layer 451 exists with a partiality toward one side of first conductor plate 5L; 3) as shown in FIG. 16C where the width of resin layer 451 existing in the center region of first band member 3L is narrowed in steps toward the terminal end thereof; 4) as shown in FIG. 16D where resin layer 451 is provided, on both sides of first conductor plate 5L and the opening width of a slit 453 is gradually widened toward the terminal end thereof; and 5) as shown in FIG. 16E where resin layer 451 is provided on both sides of first conductor plate 451 and the opening width of a slit 454 is widened in steps toward the terminal end thereof.

Also, in changing the dielectric constant between first conductor plate 5L and metallic electrode plate 32, a material having a different dielectric constant from that of resin layer 451 may be systematically added into resin layer 451 to change its effective dielectric constant.

Embodiment 3

Figure 17A:
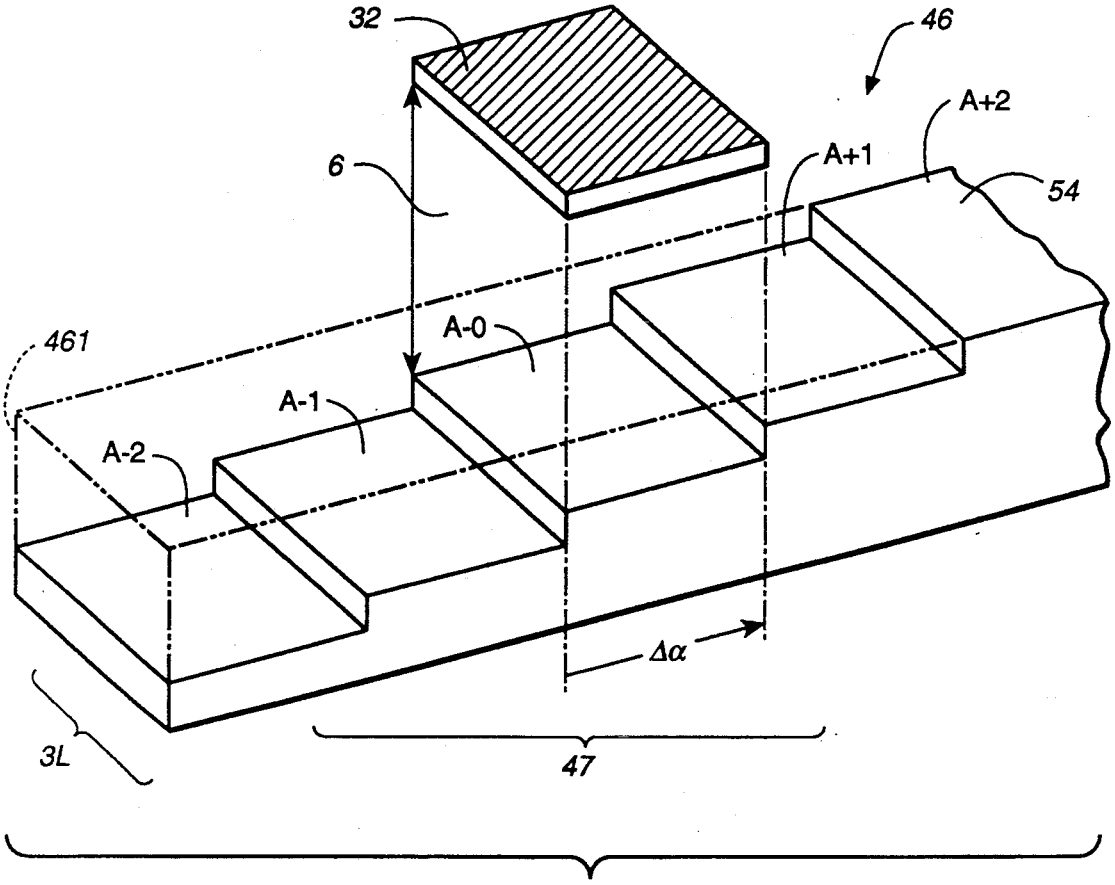
FIG. 17A shows how the overlap capacitance changes according to Embodiment 3 of the present invention; and 17B shows the shape of the band member for achieving such change.
Figure 17B:
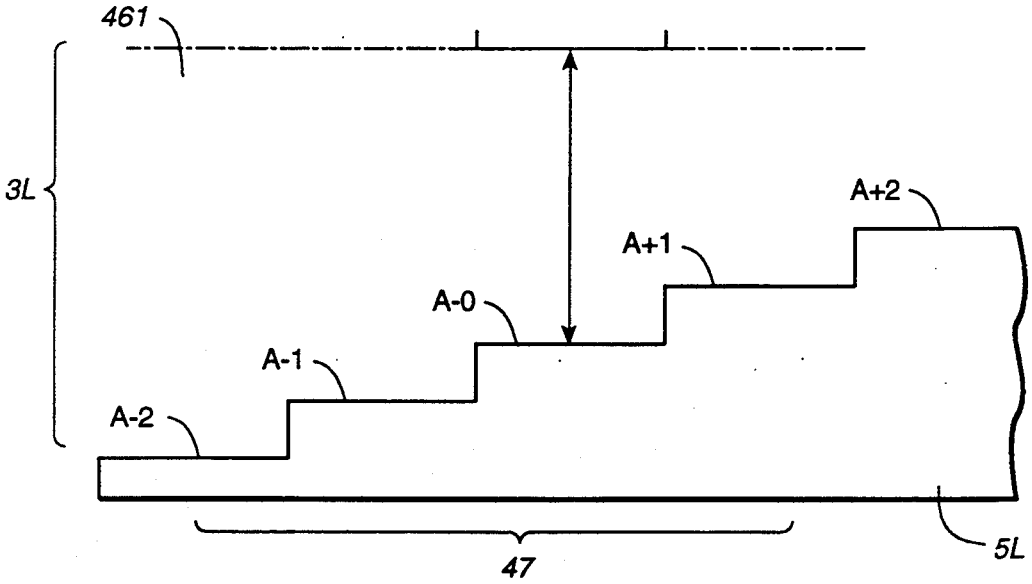

FIG. 17A shows the construction of the terminal end of a first band member of an antenna device according to Embodiment 3 of the present invention. The same reference numerals are given to those components having corresponding functions in previously described Embodiments.

In a similar manner as in the radio apparatus according to Embodiment 1 as shown in FIG. 1, a radio apparatus 46 includes: a receiver body 2 having within a casing 21, a circuit board 22, and a circuit block 23 for the radio apparatus; and an arm attaching band 3 having first and second band members 3L, 3R connected to the sides of receiver body 2. A metallic buckle 31 is attached to an end portion of second band member 3R of arm attaching band 3. First and second conductor plates 5L, 5R are integrally fixed onto first and second band member 3L, 3R, respectively.

Arm attaching band 3 may be connected via buckle 31 at its band connector portion 30, and, in their connected state, first and second band members 3L, 3R are able to form a loop.

On antenna 5 at band connector portion 30, a capacitor 6 is formed between the end portion of first conductor plate 5L and a metallic electrode plate 32 integrally formed with buckle 31. As shown in FIGS. 9A–B, capacitor 6 and a variable capacitor 232 are serially connected with inductor $L_1$ (i.e., first conductor plate 5L) and inductor $L_2$ (i.e., second conductor plate 5R.

In radio apparatus 46, as the loop length of antenna 5 changes according to the thickness of the wearer's arm, an antenna inductance L formed of first conductor plate 5L (inductance $L_1$) and second conductor plate 5R (inductance $L_2$) is changed and, as a result, the resonance frequency is shifted. Thus, in arm-attached type radio apparatus 46, capacitance $C_1$ of capacitor 6 is varied in connection with the shift in the antenna inductance L to compensate for the shift in resonance frequency f. Specifically, capacitor 6 is expressed by Eq. (8) and capacitance $C_1$ thereof is defined by the opposing area A, dielectric constant and distance d of the electrode. Radio apparatus 46 has a thickness changing portion 47 in which the thickness of first conductor plate 5L becomes thinner toward the terminal end side thereof to increase the thickness of a resin layer 461 of first band member 3L. In thickness changing portion 47, depending on the opposing position of metallic electrode plate 32 and first conductor plate 5L, while the opposing area A and the dielectric constant of capacitor 6 are constant, the opposing distance d between metallic electrode plate 32 and first conductor plate 5L is changed. In radio apparatus 46, when the loop length of antenna 5 is increased, the value of antenna inductance L becomes larger, and capacitance $C_1$ becomes smaller. Thus, the product of antenna inductance L and composite capacitance $C_t$ (formed of capacitance $C_1$ of capacitor 6 and capacitance $C_2$ of variable capacitor 232) is kept constant, whereby a change in resonance frequency f does not occur as a function of the thickness of the wearer's arm.

A computation result with respect to the structure of thickness changing portion 47 will now be described. In this computation result, a description will be given with respect to a case where capacitance $C_2$ of variable capacitor 232 is taken to be 8 pF and its effect on the composite capacitance $C_t$ cannot be ignored. In order to facilitate the handling of thickness changing portion 47 in computation, it is supposed that the thickness of first conductor plate 5L is reduced and the: thickness of resin layer 461 is increased when displaced by 10 mm toward the terminal end thereof, and that the opposing position of metallic electrode plate 32 is displaced from the state as shown in FIG. 17A by 10 mm at a time. The width of first conductor plate 5L is 7 mm and the thickness of resin layer 461 (i.e., opposing distance) is 3.00 mm.

It should be noted that setting is such that the composite capacitance $C_t$ formed of the value $C_1$ of capacitor 6 and value $C_2$ of variable capacitor 232 at the reference position as shown in FIG. 17A is 0.8 pF, 1.6 pF, 2.6 pF, 4.0 pF or 5.3 pF. For these, it is set such that: the dielectric constant of resin layer 461 is 4.35 for the case of the composite capacitance $C_t$ being 0.8 pF; the dielectric constant of resin layer 461 is 9.68 for the case of the composite capacitance $C_t$ being 1.6 pF; the dielectric constant of resin layer 461 is 19.36 for the case of the composite capacitance $C_t$ being 2.6 pF; the dielectric constant of resin layer 461 is 38.72 for the case of the composite capacitance $C_t$ being 4.0 pF; and the dielectric constant of resin layer 461 is 77.44 for the case of the composite capacitance being 5.3 pF. Under such condition, if the wearer's arm is relatively thick, metallic electrode plate 32 is slid by 10 mm at a time from the state as shown in FIG. 17A toward regions A−1, A−2 on the terminal end side of first conductor plate 5L so as to increase the opposing distance d. If the wearer's arm is thin, metallic electrode plate 32 is slid by 10 mm at a time toward regions A+1, A+2 on the base end side of first conductor plate 5L, so as to reduce the opposing distance d. Thus, the result of computation for the thickness of each of the regions A−2~A+2 in thickness changing portion 47 is shown in Table 5.

TABLE 6

Unit (mm)

| | Opposing region of First Conductor Plate 5L | | | | |
|---|---|---|---|---|---|
| | Terminal end side | Reference position | | Base end side | |
| | A-2 | A-1 | A-0 | A + 1 | A + 2 |
| Capacitance at ref. position 0.8pF $\epsilon_r = 4$. | 3.82 | 3.42 | 3.00 | 2.59 | 2.10 |
| Capacitance at ref. position 1.6pF $\epsilon_r = 9$. | 3.92 | 3.48 | 3.00 | 2.54 | 2.04 |
| Capacitance at ref. position 2.6pF $\epsilon_r = 19.36$ | 4.09 | 3.58 | 3.00 | 2.45 | 1.83 |
| Capacitance at ref. position 4.0pF $\epsilon_r = 38.72$ | 4.42 | 3.77 | 3.00 | 2.27 | 1.37 |
| Capacitance at ref. position 5.3pF $\epsilon_r = 77.44$ | 5.04 | 4.16 | 3.00 | 1.91 | 0.30 |

In radio apparatus 46, both antenna inductance L and capacitance $C_1$ of capacitor 6 are a function of $\Delta\alpha$ which represents the amount of shift from the reference position. Since capacitance $C_1$ is changed correspondingly to a change in the antenna inductance L on the basis of thickness changing portion 47, the product of antenna inductance L and composite capacitance $C_t$ is a constant even when the connecting position of arm attaching band 3 changes according to the thickness of a wearer's arm. Thus, value $C_1$ of capacitor 6 can compensate for the effect a change in antenna inductance L has on resonance frequency f.

Also, in changing the spacing between first conductor plate 5L and metallic electrode plate 32, it is possible to keep the thickness of first conductor plate 5L constant and to change only the thickness of resin layer 461.

Embodiment 4

Figure 18:
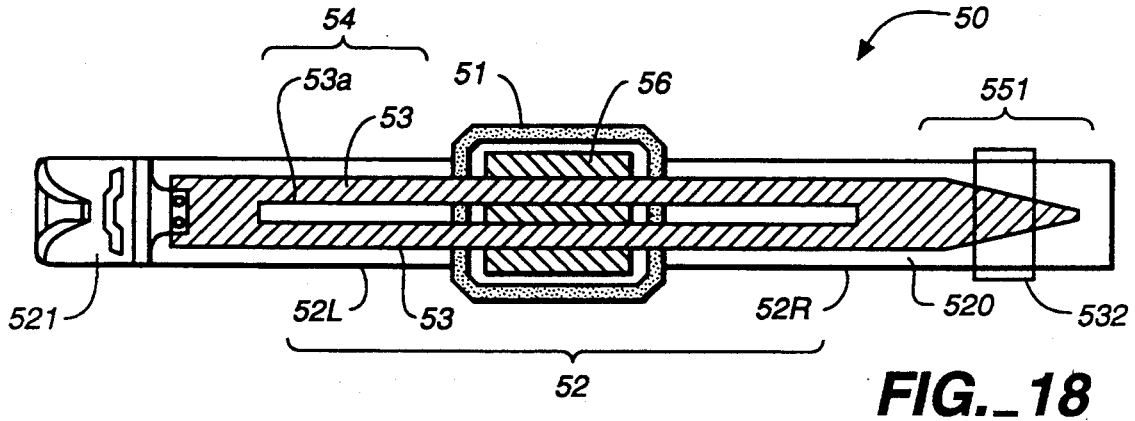
FIG. 18 is a schematic cross-sectional view from the back side of the apparatus according to Embodiment 4 of the present invention.
Figure 19:
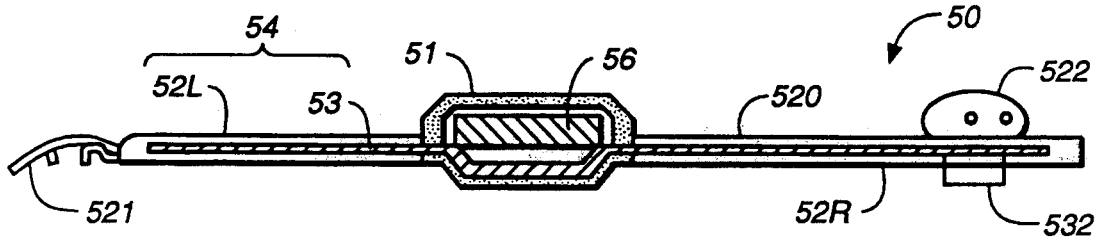
FIG. 19 is a longitudinal section of the apparatus of FIG. 18.
Figure 20:
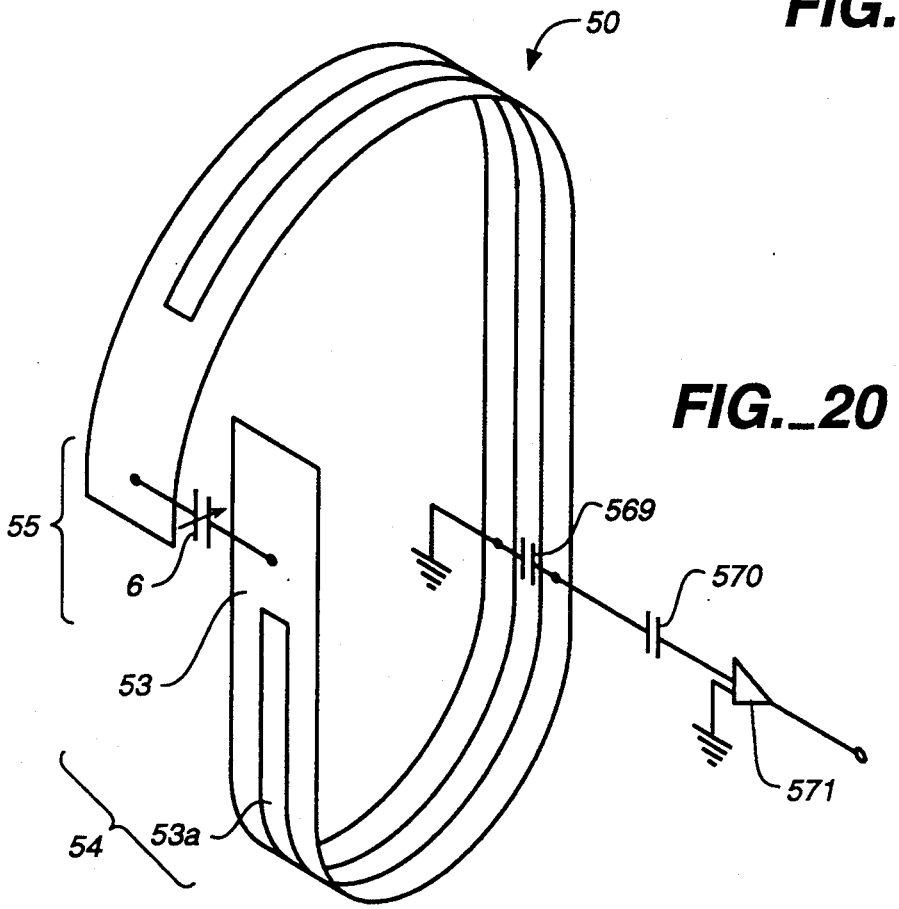
FIG. 20 is a block diagram of the antenna portion of the apparatus of FIG. 18.

Referring to FIGS. 18–19, a radio apparatus 50 includes: a case body 51 (the main body of the radio apparatus) for housing a circuit block 56 and an arm attaching band 52 connected to the sides of case body 51. Arm attaching band 52 has first and second band members 52L, 52R formed of materials such as leather, silicone resin or urethane resin. First and second band members 52L, 52R are formed integrally with a conductor plate 53 which is arranged in a state of crossing the interior of case body 51 and is fixed thereto. A slit 53*a* is formed in conductor plate 53 in the lengthwise direction, and an antenna 54 is formed by conductor plate 53 having slit 53*a*. Conductor plate 53 is provided within first and second band members 52L, 52R. Conductor plate 53 is typically covered with a sheet-like insulating material which is sewed up or a sheet-like insulating material which is bonded together. It should be noted that conductor plate 53 is formed of a thin plate-like material so that it may be bent when arm attaching band 52 is to be attached to an arm, and, for its material, one with a high conductivity is used for the purpose of reducing loss at antenna 54. As shown in FIG. 19, conductor plate 53 is so arranged within case body 51 that it passes through the lower surface side of circuit block 56. A metallic buckle 521 is attached to an end of first band member 52L. A buckle receiver 522 with which buckle 521 may be mechanically engaged is fixed on the side of second band member 52R, and metallic electrode plate 532 is fixed to the back side thereof. Since, while conductively connected to buckle receiver 522, metallic electrode plate 532 opposes conductor plate 53 via a resin layer 520 of second band member 52R, there is no conductive connection between metallic electrode plate 532 and conductor plate 53. Further, while the connecting mechanism at the band connector portion thereof will be described later, even if buckle 521 is inserted into buckle receiver 522 when arm-attached type radio apparatus 50 is to be attached to an arm via arm attaching band 52, buckle 521 is not conductively connected to conductor plate 53 within buckle receiver 522. However, in this state, conductor plate 53 and metallic electrode plate 532 as well as buckle receiver 522 are brought into the state where they oppose each other via second band member 52R. Thus, when buckle 521 and buckle receiver 522 are brought into their connected state to form arm attaching band 52 into a loop at the time of attaching radio apparatus 50 to an arm, a loop-like antenna 54 having slit 53*a* opened in its circumference is formed as shown in FIG. 20. Antenna 54 is constructed such that capacitor 6 formed between conductor plate 53 and metallic electrode plate 532.

Figure 21:
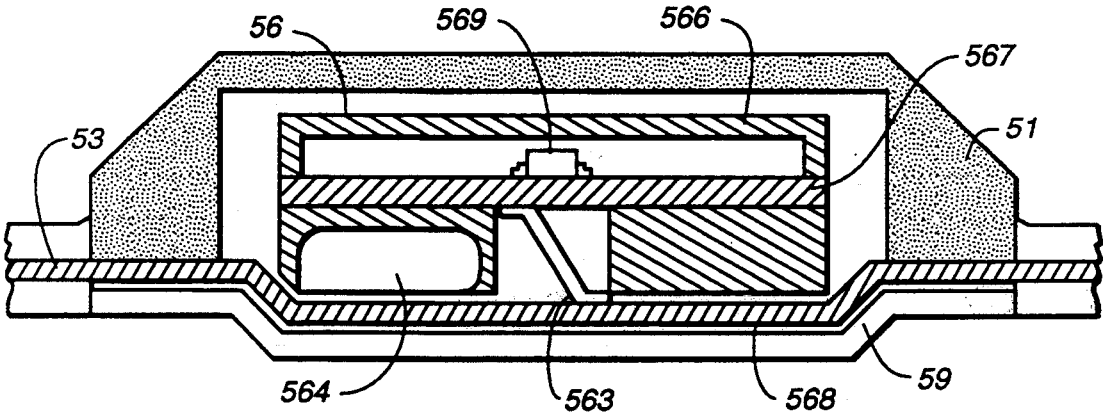
FIG. 21 is a longitudinal section showing the interior of the case body of the apparatus of FIG. 18.

As shown in FIG. 21, interior of case body 51 is enlarged, and disposed therein is a circuit case 566 having a circuit board 567 for the radio apparatus and a variable capacitor 569 for adjusting the antenna resonance frequency provided on the upper surface of circuit board 567. On the lower surface of circuit board 567, a battery 564 is provided, which serves as the power supply unit for circuit block 56. On a back lid 59, conductor plate 53 is positioned via an insulating plate 568. Conductor plate 53 and the side of circuit board 567 are electrically coupled to each other by a conductive terminal 563.

Figure 22:
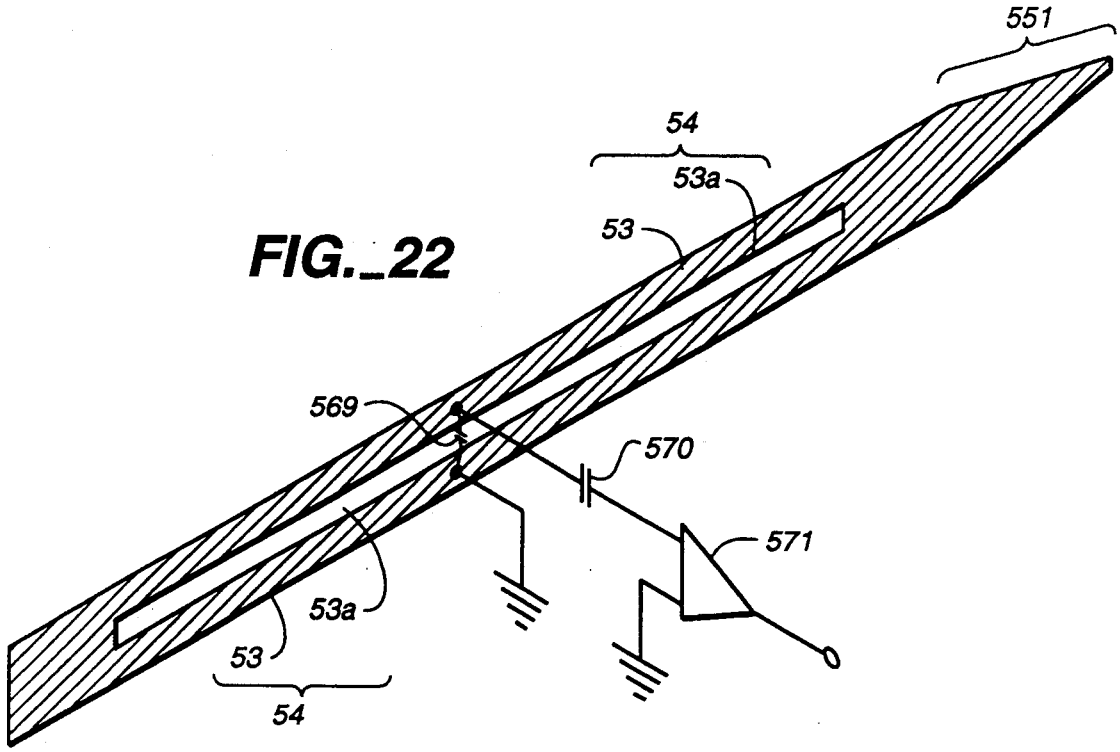
FIG. 22 is a block diagram of the circuit structure of the apparatus of FIG. 18.
Figure 23:
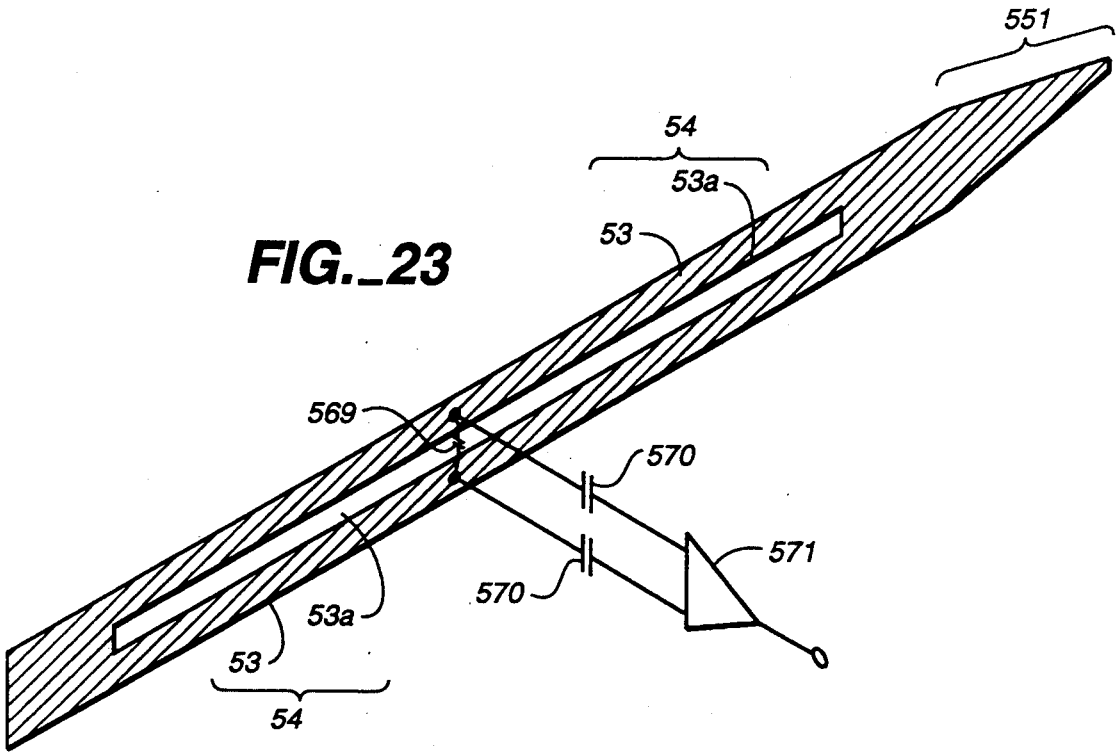
FIG. 23 is a block diagram of another circuit structure different from the circuit structure of the apparatus of FIG. 18.

As shown in FIGS. 20 and 22, variable capacitor 569 is wired to a structure loaded with respect to both sides of slit 53*a* of conductor plate 53. A high-frequency amplifier 571 formed on circuit board 567 is conductively connected via a coupling capacitor 570 to one of the sides of slit 53*a*. The other side amplifier 571 is connected to ground to form an unbalanced feed system. As shown in FIG. 23, it may also be made into a balanced feed structure such that high-frequency amplifier 571 is conductively connected via coupling capacitor 570 to both sides of slit 53*a*.

It should be noted that, while a clocking circuit and a display circuit for displaying the clock information thereof are provided on radio apparatus circuit block 56, such as a liquid crystal display (LCD) panel is provided on the upper surface of case body 51 to give a clock function to radio apparatus 50.

Figure 24:
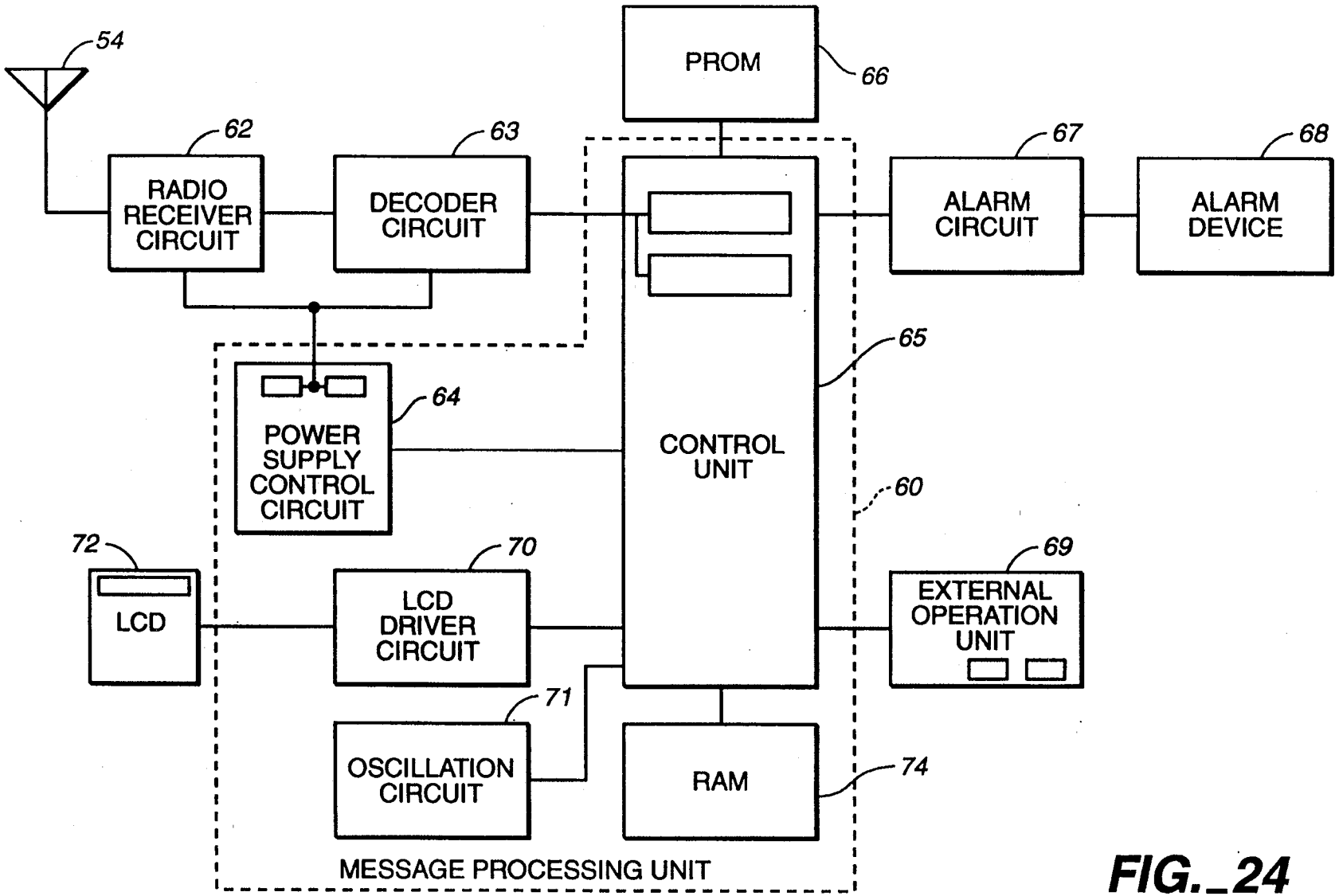
FIG. 24 is a block diagram of a circuit constructed at the interior of the case body of the apparatus of FIG. 18.

FIG. 24 shows a radio receiver circuit 62, a decoder circuit 63, a power supply control circuit 64 for controlling power supply to radio receiver circuit 62 and decoder circuit 63, and a control unit 65 for controlling power supply control circuit 64 are provided for antenna 54. In addition, provided are: a programmable read only memory (PROM) 66 in which a unique calling number to be compared at control unit 65 is stored; an LCD driver circuit 70 for driving an LCD 72 for displaying information; and an oscillation circuit 71 containing a crystal oscillator for generating a clock signal to be used in controlling LCD driver circuit 70. Furthermore, while connected to an external operation unit 69 for inputting a command from the outside to control unit 65, control unit 65 is connected to RAM 74 for storing transmitted information associated with a unique calling number and reference time information. A message processing unit 60 is formed by RAM 74, oscillation circuit 71, LCD driver circuit 70, control unit 65 and power supply control unit 64. An alarm system is connected to control unit 65 comprising alarm circuit 67 and alarm device 68 to indicate the receipt of a call signal.

Figure 25:
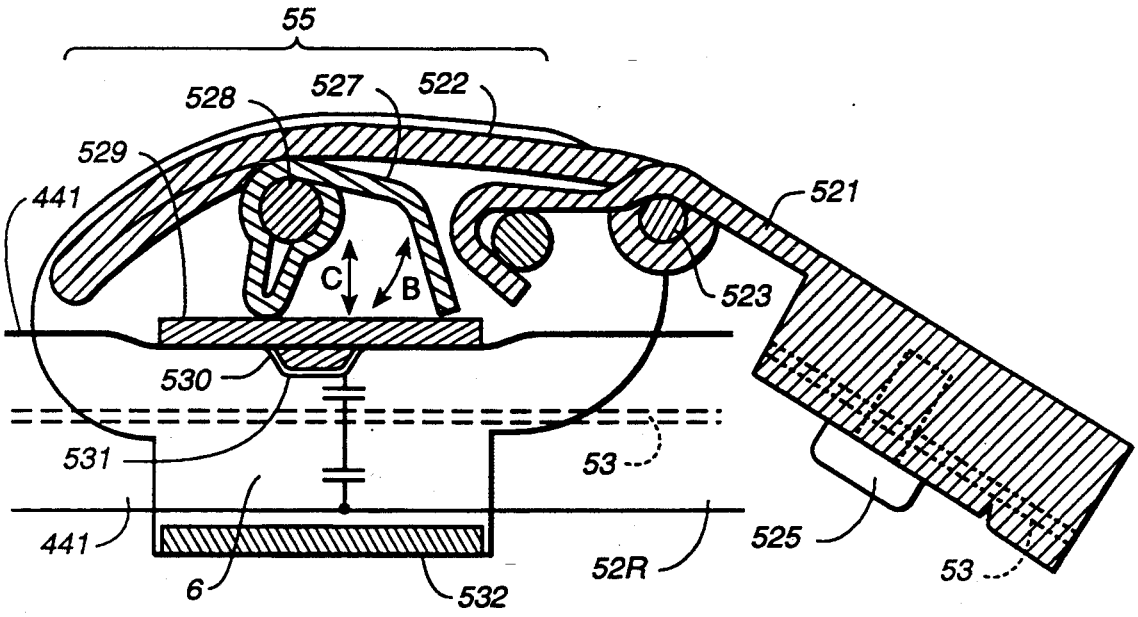
FIG. 25 is a cross-sectional view showing the buckle in an engaged state.

In arm-attached type radio apparatus 50 having such construction, buckle receiver 522 and metallic electrode plate 532 are changed in their position with respect to second band member 52R according to the thickness of the wearer's arm. For example, when attaching onto a relatively thin arm, they are fixed to a position displaced by a certain pitch at a time from the terminal end of second band member 52R toward case body 51. Specifically, as shown in FIG. 25, buckle 521 is connected via a screw 525 to conductor plate 53 at band connector portion 55. It is rotatable about the axial line of a rotation axis 523 while the terminal end side thereof remains to be engaged with a hooking axis 524. A fastener 527 is rotatable about the axial line of rotation axis 528. As shown in FIG. 25, fastener 527 is rotated in the direction of arrow B to restrict a metallic holding plate 529. When, from this state, fastener 527 is rotated in the direction of arrow C, the restricted state of holding plate 529 by fastener 527 with respect to second band member 52R is released. In this released state, second band member 52R is displaced with respect to buckle receiver 522 according to the thickness of the arm to adjust the loop length of arm attaching band 52. At this time, the position of second band member 52R after such displacement is limited to each position at which concave portion 530 formed intermittently on the surface thereof engages a projection 531 of holding plate 529.

When the fastening position with respect to second band member 52R is adjusted in accordance with the thickness of the arm, the loop length of antenna 54 is changed by the thickness of the wearer's arm, since the portion passed through buckle 522 does not contribute to the loop length of antenna 54. Accordingly, resonance frequency f of radio apparatus 50 is necessarily shifted. Thus, in arm-attached type radio apparatus 50, an area changing portion 551 of which the width is narrowed toward the terminal end thereof is formed, as shown in FIG. 18, on the end of the side of second band member 52R of conductor plate 53, so that the opposing area between metallic electrode plate 532 and conductor plate 53 is changed according to the fastening position with respect to second band member 52R.

That is, when it is used by a user having a thick arm, the loop length of antenna 54 becomes longer and the opening area thereof is extended so that the value of the antenna inductance L is increased, the opposing area between conductor plate 53 and metallic electrode plate 532 is reduced to reduce the value $C_1$ of capacitor 6 formed between metallic electrode plate 532 and conductor plate 53. For this reason, the product of antenna inductance L and composite capacitance $C_t$ (formed of value $C_1$ of capacitor 6 and variable capacitor 569) remains constant. Therefore no shift in resonance frequency f results, and the antenna gain is at a high level.

Figure 26A:
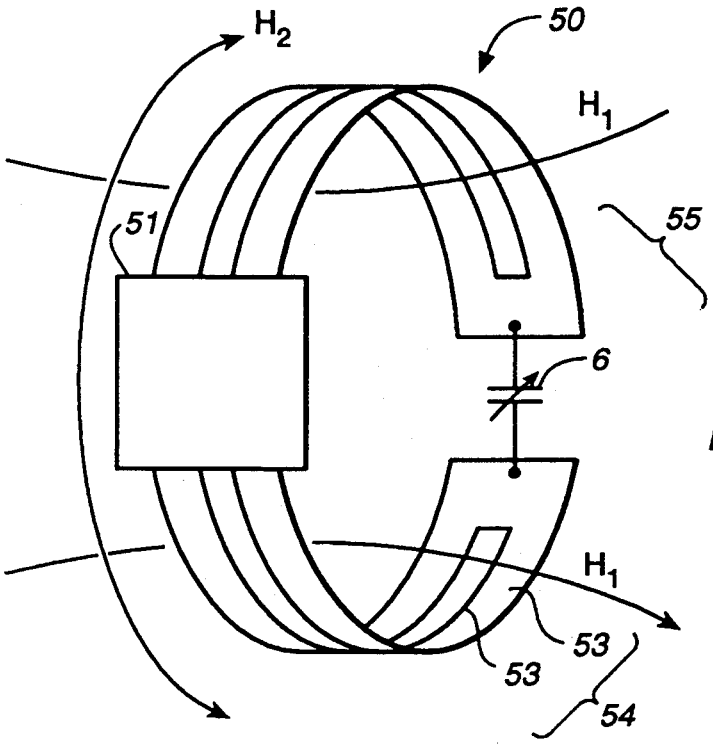
FIG. 26A is a view explanatory of the directivity of the apparatus of FIG. 18; and (b) is a view for explaining the difference from such directivity.
Figure 26B:
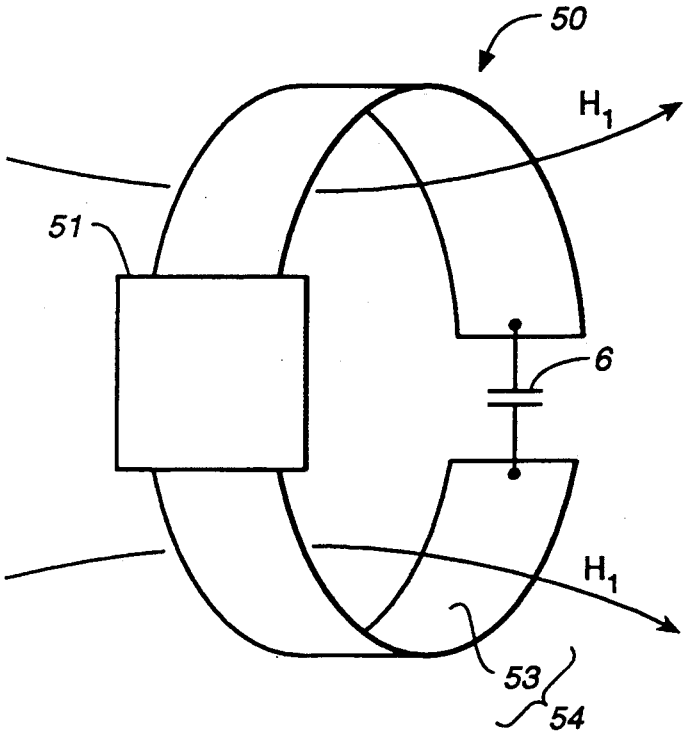
Figure 27A:
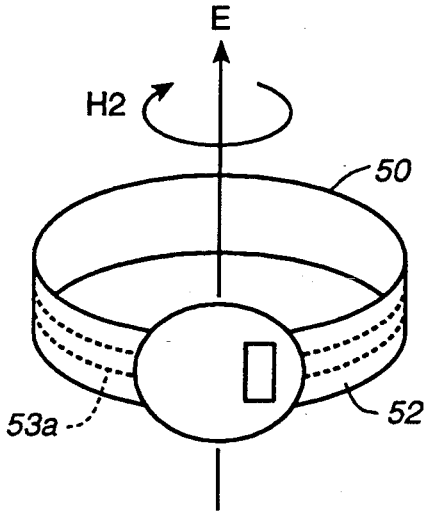
FIG. 27A shows the state where an arm-attached type radio apparatus is left alone in the appraisal of the directivity; (b) shows the state where the directivity is appraised by attaching the same to an arm; and (c) is a graph showing the result of the appraisal of the directivity in these states.
Figure 27B:
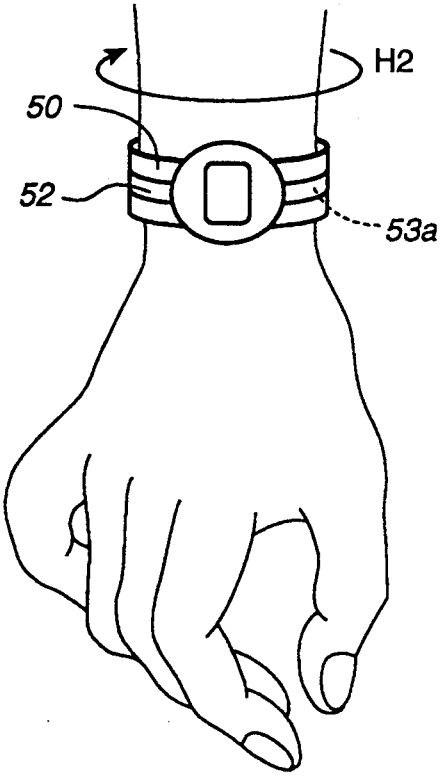
Figure 27C:
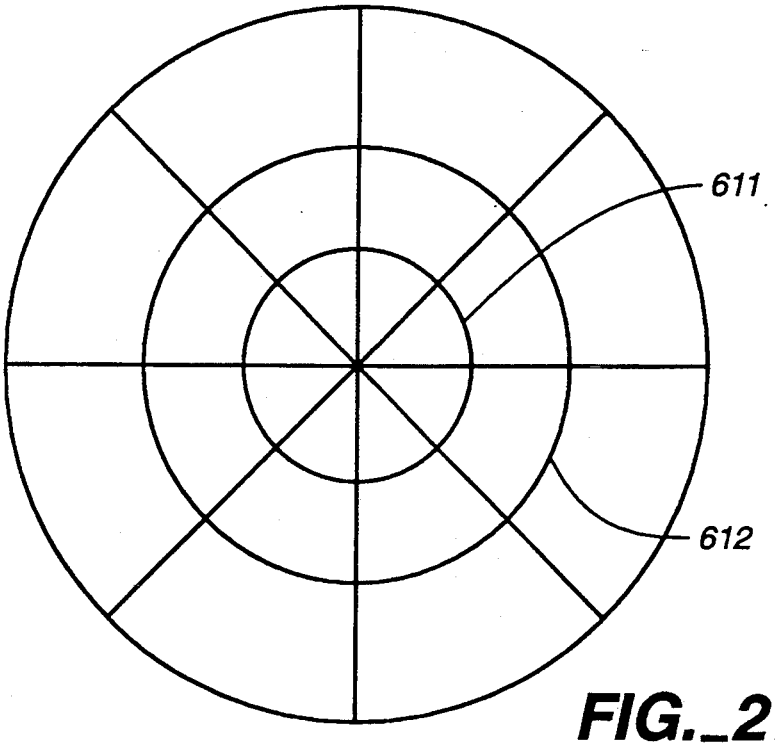
Figure 29A:
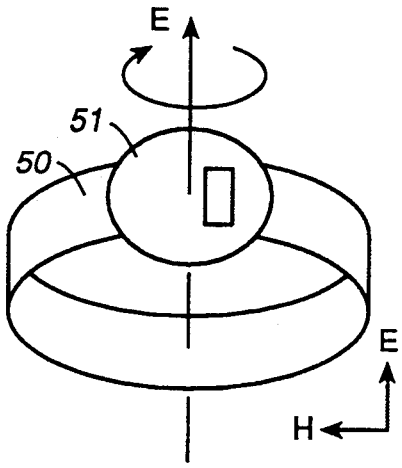
FIG. 29A shows the state where an arm-attached type radio apparatus is left alone in the appraisal of the directivity of the arm-attached type radio apparatus of FIG. 18;29B shows the state where the directivity is appraised by attaching the same to an arm; and 29C is a graph showing the result of the appraisal of the directivity in these states.
Figure 28:
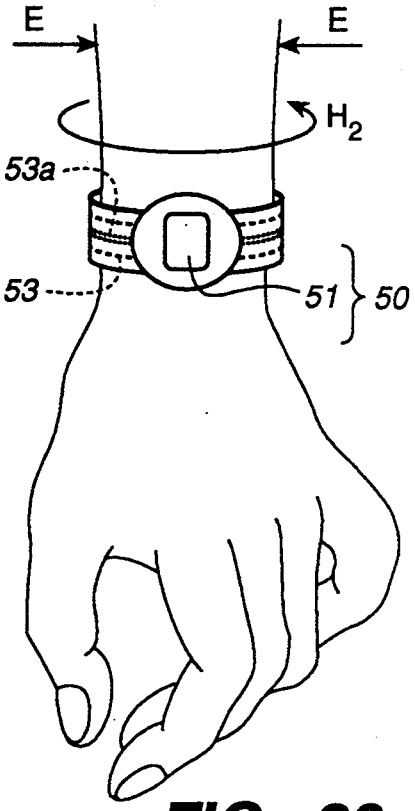
FIG. 28 is a view explanatory of the state where an arm is extended horizontally while an arm-attached type radio apparatus is attached to the arm in the appraisal of directivity.
Figure 29B:
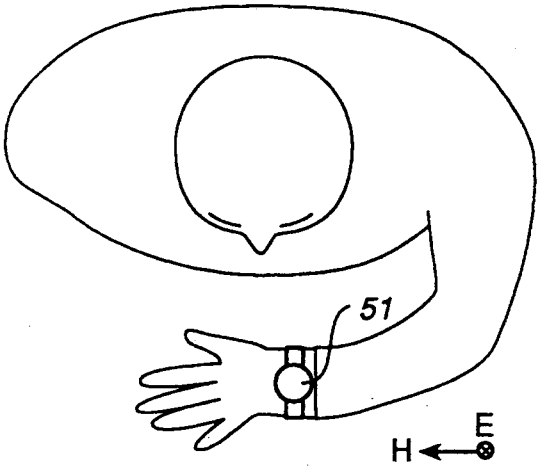
Figure 29C:
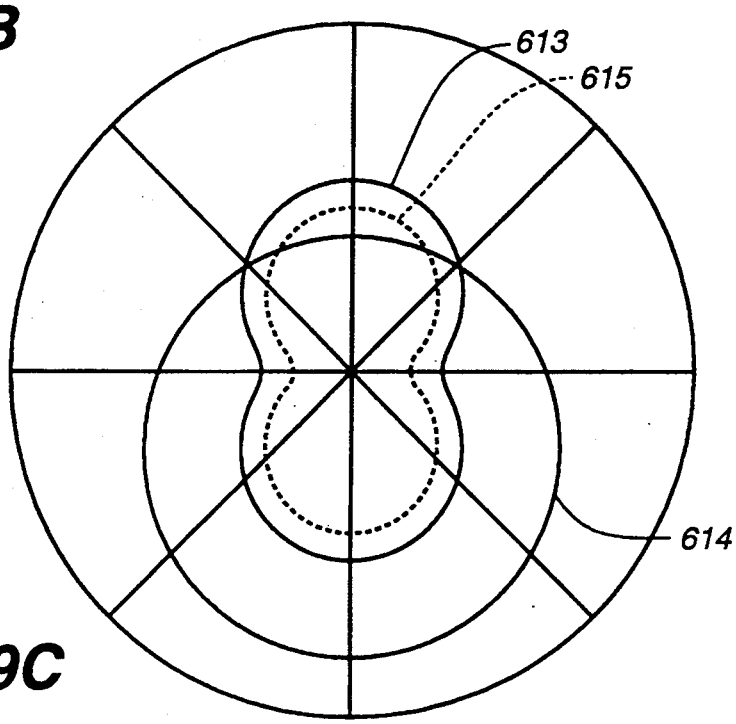
Figure 30:
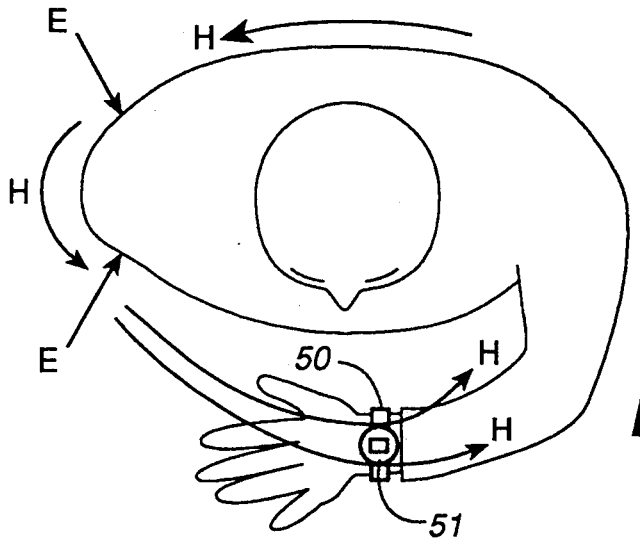
FIG. 30 is a view explanatory of the state where an arm is bent in front of the body while an arm-attached type radio apparatus is attached to the arm in the appraisal of directivity.
Figure 31:
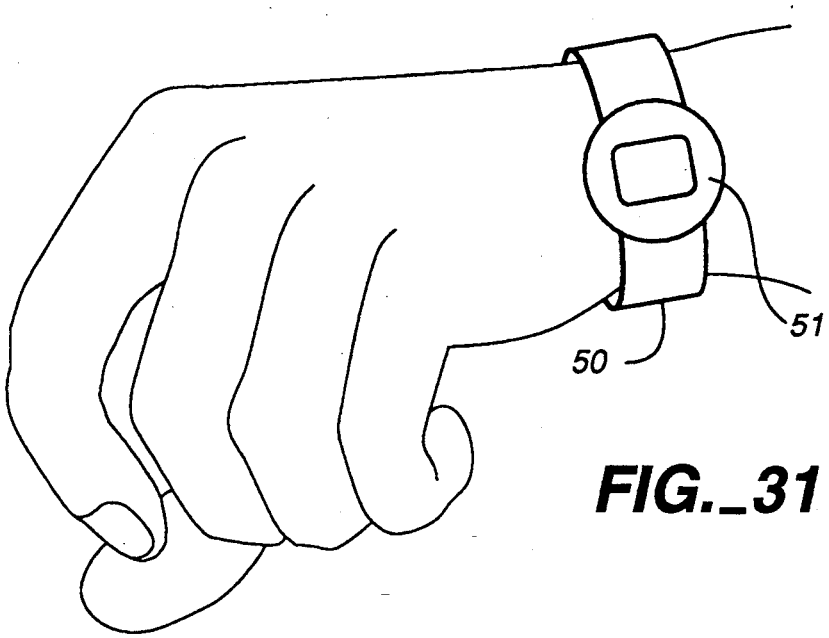
FIG. 31 is a view explanatory of the state where an arm is bent at the side of the body while an arm-attached type radio apparatus is attached to the arm in the appraisal of the directivity of the arm-attached type radio apparatus as shown in FIG. 18.
Figure 35:
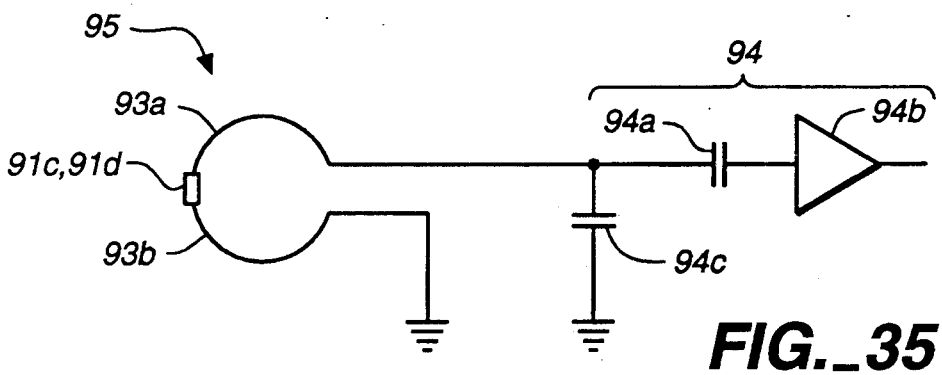
FIG. 35 (PRIOR ART)
FIG. 35 is a block diagram of the apparatus of FIG. 34.

Further, in the arm-attached type radio apparatus 50 of the present example, by connecting first and second band members 53L, 53R into a loop, conductor plate 53 fixed at their interior forms a loop antenna and it furthermore forms a slot antenna having a slit 53*a* opened toward the outer periphery thereof. For this reason, arm attached type radio apparatus 50, in addition to the fact that it may respond as a loop antenna as shown in FIG. 26B to a magnetic field component H1 directed toward the opening direction of antenna 54, is also responsive as shown in FIG. 26A to a magnetic field component H2 along the circumferential direction thereof. Thus, under a condition where, as shown in FIG. 27A, an electric field component E in the vertical direction exists, the antenna directivity of arm-attached type radio apparatus 50 in the state left alone with its arm attaching band 52 remaining in the horizontal direction is non-directional as indicated by solid line 611 in FIG. 27C. Further, as shown in FIG. 27B, even in the state where the arm is hung while arm-attached type radio apparatus 50 remains to be attached to the arm, the directivity of the antenna thereof is non-directional as indicated by solid line 612 in FIG. 27C. In addition, arm-attached type radio apparatus 50 is suitable for being carded, since its sensitivity is higher when attached to a human body because it is of a magnetic field detecting type. Further, as shown in FIG. 28, even in the state where the arm is horizontally extended while it remains to be attached on the arm, it responds, as slot antenna to the magnetic field component H2 in the peripheral direction thereof corresponding to the electric field component E in the vertical direction. As shown in FIG. 29A, in the state where arm-attached type radio apparatus 50 is left alone with case body 50 being directed upward, while the directivity thereof is as indicated by solid line 613 in FIG. 29C a directivity composed of the directivity of the loop antenna and the directivity of the slot antenna, it is different from the directivity of the loop antenna (directivity being indicated by broken line 615) shown as a comparison example in that it has no unevenness in the directivity. Furthermore, in the state where the arm is bent as shown in FIG. 29B in the front of the body while arm-attached type radio apparatus 50 being left attached on the arm, the distribution of the magnetic field component (indicated by arrow E) and the electric field component (indicated by arrow H) thereof is assumed to form a complicated distribution, for example, as shown in FIG. 30. The directivity thereof slightly exhibits an orientation as, the magnetic field component from the back side is cut off as indicated by solid line 614 in FIG. 29C. Even so, it has been confirmed to be substantially non-directional as the magnetic field component is strengthened by the human body. Note that, if the arm is positioned at a side of the body as shown in FIG. 31, it furthermore approaches the non-directional state, since the degree by which it is cut off by the body is lower.

Modification of Embodiment 4

As shown in FIGS. 32–33, radio apparatus 80 includes: a case body 81 (main body of the radio apparatus) having a circuit block 86 for radio apparatus arranged at the interior thereof; and an arm attaching band connected to the sides thereof having first and second band members 82L, 82R formed of, for example, a resin. First conductor and second plates 831, 832 are integrally formed on and fixed to first and second band members 82L, 82R, respectively. First and second conductor plates 831, 832 have slits 83*a*, 83*b* formed, respectively, on the sides thereof, and an antenna 84 of arm-attached type radio apparatus 80 is formed by first and second conductor plates 831, 832 having slits 83*a*, 83*b*.

Slits 83*a*, 83*b* are formed in the lengthwise direction of first and second conductor plates 831, 832. Slits 83*a*, 83*b* have opened ends at their edges toward the sides of case body 81. Thus, by slits 83*a*, 83*b*, the side of first conductor plate 831 is separated into one side end portion 831*a* and the other side end portion 831*b*, and the side of conductor plate 832 is also separated into one side end portion 832*a* and the other side end portion 832*b*. Moreover, side end portion 831*a* and side end portion 832*a* are electrically coupled to each other at the interior of case body 81, and side end portion 831*b* and side end portion 832*a* are electrically coupled to each other at the interior of case body 81. Specifically, both side surface portions of case body 81 are formed integrally with two each of conductive terminals 821*a*, 821*b*, 821*c*, 821*d*, and to the respective end portion thereof, the one side end portion 831*a* and the other side end portion 831*b* of first conductor plate 831 and the one side end portion 832*a* and the other side end portion 832*b* of second conductor plate 832 are electrically coupled by means such as soldering. Conductive terminals 821*a* and 821*c* are conductively connected to each other via one side circuit pattern 867*a*. Conductive terminals 821*b*, 821*d* are conductively connected to each other via side circuit pattern 867*b*. As shown in FIG. 33, conductive terminals 821*a*, 821*b*, 821*c*, 821*d* have bent portions, respectively, at the positions of their conductive connection with radio apparatus circuit block 86, and they are conductively connected to one side circuit pattern 867*a* and another side circuit pattern 867*b* of radio apparatus circuit board 867 by means of the spring property of the bent portions. Thereby, it is constructed so that a vibration is not propagated to the interior of case body 81. It should be noted that a variable capacitor 869 for adjusting the antenna resonance frequency is coupled between side circuit patterns 867*a* and 867*b*, and a battery 864 is positioned at the lower surface side of radio apparatus circuit board 867.

In arm-attached type radio apparatus 80 having such construction, in addition to the advantage obtained in the arm-attached type radio apparatus according to Embodiment 4 that the antenna gain may be maintained at a high level because the resonance frequency is not caused to shift according to the thickness of the wearer's arm, the following advantages are also achieved. That is, first and second conductor plates 831, 832 are formed respectively on the side of first band member 82L or second band member 82R, and they are electrically connected to the side of case body 81 via conductive terminals 821*a*, 821*b*, 821*c*, 821*d*, thereby the side of case body 81 and the side of the arm attaching band are formed as separate bodies from each other. Thus, if only the side of the arm attaching band is damaged in the course of using arm-attached radio apparatus 80, it is possible to remove the side of the arm attaching band from case body 81 for replacement.

In addition, since arm-attached type radio apparatus 80 may be fabricated by each component, there is another advantage that its productivity is relatively higher.

It should be noted that, in both arm-attached type radio apparatus according to Embodiment 4 and the modification of Embodiment 4, the change in the area of the side of the conductor plate is used as the resonance frequency compensation means. Instead, however, a shift in the resonance frequency caused by the thickness of the wearer's arm may also be compensated for by changing by each region the ratio of the resin layer on the band member (effective-dielectric-constant changing portion) or the thickness thereof (thickness changing portion).

As described above, an arm-attached type radio apparatus according to the present invention is characterized in that it includes a resonance frequency compensation means by which a shift in the resonance frequency caused by a change in the loop length of the antenna is compensated by changing opposing area, dielectric constant or opposing distance of an overlap capacitance formed between a conductor plate and an electrode portion formed on a band connector portion. Thus, according to the present invention, even when the loop length is changed by the thickness of the arm, causing a change in the inductance value, the capacitance of the overlap capacitor is changed so as to keep the product of inductance and capacitance constant. Since the resonance frequency is not shifted, an advantage is achieved that the antenna gain may be maintained at a high level.

Also, where a slit is formed in the lengthwise direction of the conductor plate forming the antenna, the directivity characteristic of the antenna may be improved, since it also functions as a slot antenna.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the subjoined claims.

APPENDIX I

1,40, 46, 50, 80, . . . arm-attached type radio apparatus

2, . . . receiver body
3, 52 . . . arm attaching band
3L, 52L, 82L . . . first band member
3R, 52R, 82R . . . second band member
5, 54, 84 . . . antenna
5L, 831 . . . first conductor plate
5R, 832 . . . second conductor plate
6 . . . electric coupling capacitance
10 . . . antenna circuit
15 . . . area changing portion
21 . . . casing
22 . . . circuit board
23, 56, 86 . . . circuit block for radio apparatus
24 . . . antenna input terminal
30, 55 . . . band connector portion
31 . . . buckle
32, 532 . . . metallic electrode plate
45 . . . effective-dielectric-constant changing portion
47 . . . thickness changing portion
51, 81 . . . case body
53 . . . conductor plate
53*a*, 83*a*, 83*b* . . . slit
232, 569, 869 . . . variable capacity capacitor
233, 570 . . . coupling capacitor
441, 451, 461 . . . resin layer
452 . . . air layer
521 . . . buckle
522 . . . buckle receiver
520 . . . resin layer
566 . . . circuit case
551 . . . area changing portion
H1, H2 . . . magnetic field component
E . . . electric field component

APPENDIX II

Nagaoka Coefficient

Self-inductance of solenoid with infinite length

Figure 36:
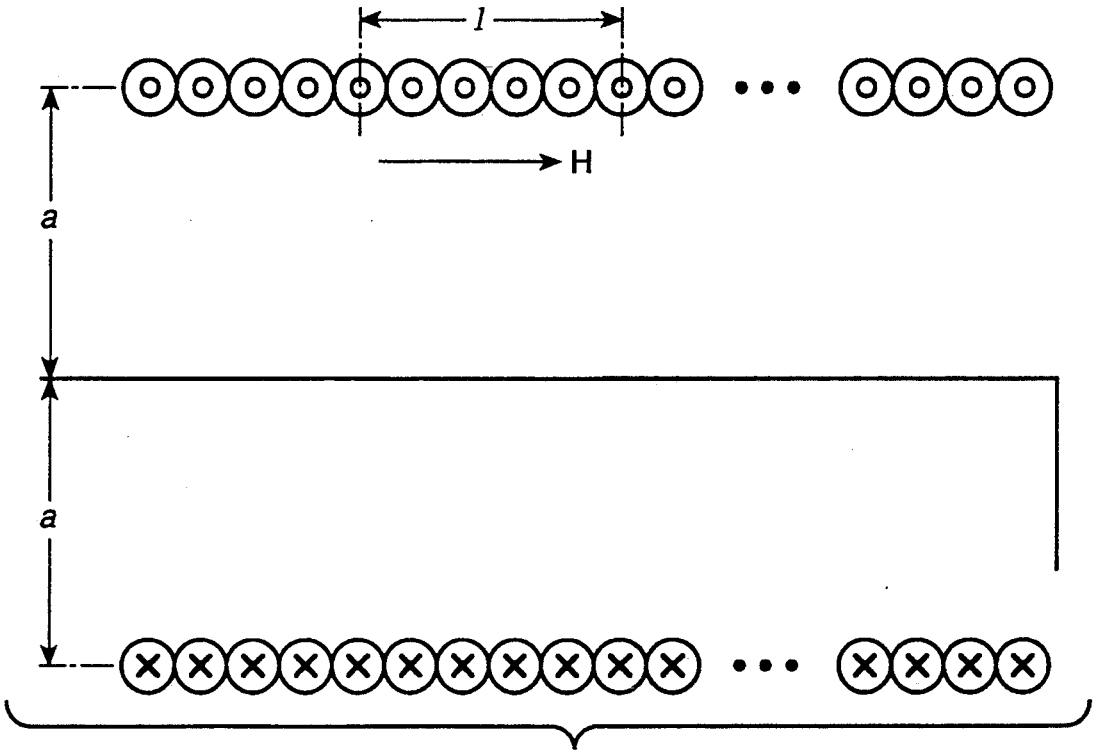
FIG. 36 (PRIOR ART)
FIG. 36 shows a cross-section of a solenoid in connection with an explanation of the Nagaoka coefficient.
Figure 37A:
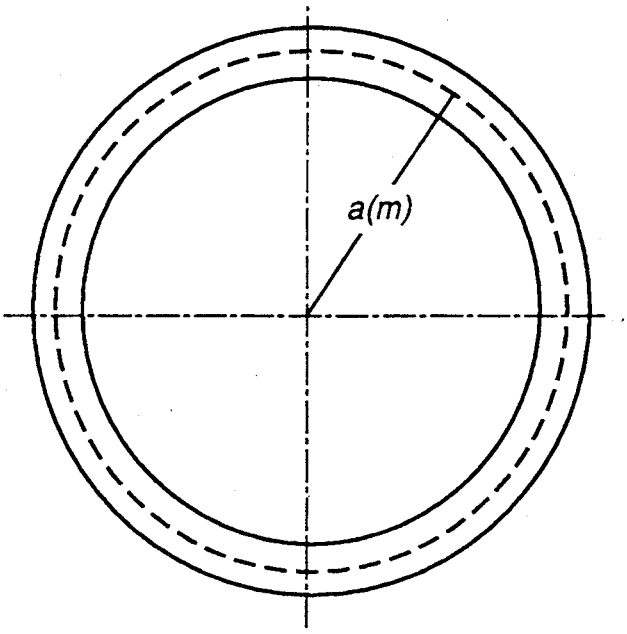
FIG. 37A (PRIOR ART)
FIGS. 37A and 37B are illustrations of solenoids in connection with an explanation of the Nagaoka coefficient.

A process for calculating the self-inductance for unit length of an infinitely long solenoid having radius a (m) (as shown in FIGS. 36 and 37) is described below.

When current "I(A)" is applied to a solenoid coil (for unit length) having number of turns "n", magnetic field "H" inside a coil is shown by the following formula, $$H=nI[A/m] \quad \text{(Eq. A2.1)}$$

Therefore, internal flux density "B" is shown by, $$B=\mu_0 H=\mu_0 In[T] \quad \text{(Eq. A2.2)}$$

The cross section of a solenoid is given by $S=\pi a^2$, so all magnetic flux "$\phi$" inside a solenoid is given by, $$\phi=SB=\mu_0 In\pi a^2[WB] \quad \text{(Eq. A2.3)}$$

Figure 37B:
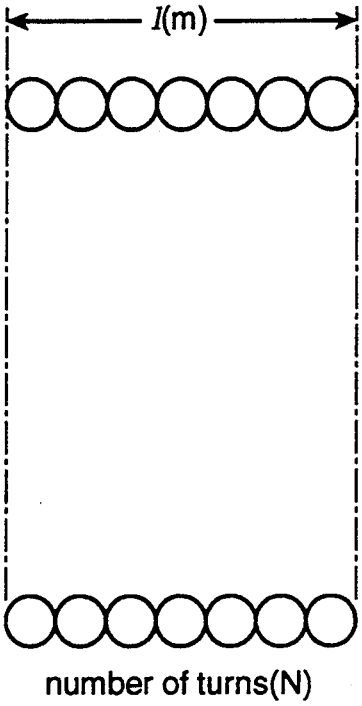
FIG. 37B (PRIOR ART)

The number of turns in a one 1 m interval is "n" (FIGS. 36 and 37B). Therefore, the interlinkage number of the magnetic flux at 1 m interval is given by, $$n\phi=\mu_0 In^2\pi a^2[Wb/m] \quad \text{(Eq. A2.4}$$

Therefore self-inductance for unit length is calculated as follows, dividing by current "I", $$L=\mu_0 n^2\pi a^2[H/m] \quad \text{(Eq. A2.5)}$$

Furthermore, self-inductance (L) for l(m) length of infinite long solenoid coil is times as large as the above formula (Eq. A2.5). It is calculated as the following formula (In this case, total number of turns is $N=n\phi$.

$$L=\frac{\mu_0\pi a^2 N^2}{l}[H] \quad \text{(Eq. A2.6)}$$

Self-inductance of solenoid with finite length

Self-inductance for total length l(m) of finite long solenoid coil (shown in FIG. 37B is smaller than self-inductance of l(m) length of infinite one, because a magnetic field of finite solenoid coil is weakened than the above H=nI. Therefore it is shown as the following formula.

$$L=\mathcal{L}\mu_0\pi a^2\frac{N^2}{l}[H] \quad \text{(Eq. A2.7)}$$

Numeral $\mathcal{L}$ represents the Nagaoka coefficient which functions to make up for the weakened magnetic field. Nagaoka coefficient has the following values as shown in Table A2.I. This coefficient is determined by length and radius of a coil. As a coil gets longer compared with radius, is getting near 1 (namely self-inductance of infinite long solenoid).

TABLE A2.I

Nagaoka coefficient

| $2a\pi$ | $\mathcal{L}$ | $2a\pi$ | $\mathcal{L}$ | $2a\pi$ | $\mathcal{L}$ | $2a\pi$ | $\mathcal{L}$ |
|---|---|---|---|---|---|---|---|
| 0 | 1.0 | 0.55 | 0.803 | 1.10 | 0.667 | 2.50 | 0.472 |
| 0.05 | 0.979 | 0.60 | 0.789 | 1.20 | 0.648 | 3.00 | 0.429 |
| 0.10 | 0.959 | 0.65 | 0.775 | 1.30 | 0.629 | 3.50 | 0.394 |
| 0.15 | 0.939 | 0.70 | 0.761 | 1.40 | 0.611 | 4.00 | 0.365 |
| 0.20 | 0.920 | 0.75 | 0.748 | 1.50 | 0.595 | 4.50 | 0.341 |
| 0.25 | 0.902 | 0.80 | 0.735 | 1.60 | 0.580 | 5.00 | 0.320 |
| 0.30 | 0.884 | 0.85 | 0.723 | 1.70 | 0.565 | 6.00 | 0.285 |
| 0.35 | 0.867 | 0.90 | 0.711 | 1.80 | 0.551 | 7.00 | 0.258 |
| 0.40 | 0.850 | 0.95 | 0.700 | 1.90 | 0.538 | 8.00 | 0.237 |
| 0.45 | 0.834 | 1.00 | 0.698 | 2.00 | 0.526 | 9.00 | 0.219 |
| 0.50 | 0.818 | | | | | 10.00 | 0.203 |

What is claimed is:

1. An antenna device for a radio apparatus comprising:

a) a first electrically insulating and a second electrically insulating band member, said first and second band members having respectively, a first conductor plate and a second conductor plate attached thereto, such that said first and second conductor plates are substantially insulated, and one end of each of said first and second band members is connected to said radio apparatus;

b) a band connector attached to said first band member, for forming a loop of variable length by detachably connecting said first and second band members at one of a predetermined plurality of band connection positions, and having an electrode provided thereon such that when said first and second band members are connected by said band connector an overlap capacitance is formed between said electrode and said second conductor plate; and c) a resonance frequency compensation means operable for changing the magnitude of said overlap capacitance in proportion to a change in antenna inductance, wherein said change in antenna inductance is caused by change in antenna loop length.

2. The device of claim 1 wherein said resonance frequency compensation means includes an area changing portion on a side of said second conductor plate for changing the capacitance of said overlap capacitance by changing an opposing area between said electrode and said second conductor plate on the basis of the connecting position of said first and second band members.

3. The device of claim 2 wherein said first and second conductor plates each have a slit formed thereon in their lengthwise direction.

4. The device of claim 1 wherein said resonance frequency compensation means includes an effective-dielectric-constant changing portion on a side of said second band member, for changing the effective dielectric constant between said electrode and said second conductor plate on the basis of the connecting position of said first and second band members.

5. The device of claim 4, wherein said first and second conductor plates each have a slit formed thereon in their lengthwise direction.

6. The device of claim 1 wherein said resonance frequency compensation means includes a thickness changing portion on a side of said second band member, for changing the opposing distance between said electrode and said second conductor plate on the basis of the connecting position of said first and second band members.

7. The device of claim 6 wherein said first and second conductor plates each have a slit formed thereon in their lengthwise direction.

8. The device of claim 1 wherein said electrode comprises a conductive plate.

9. The device of claim 8 wherein said conductive plate comprises a metallic plate.

10. The device of claim 1 wherein said first and second conductor plates each have a slit formed therein in their lengthwise direction.

11. A wireless apparatus comprising an antenna which includes:

a) a first electrically insulating and a second electrically insulating band member, said first and second band members having respectively, a first conductor plate and a second conductor plate attached thereto, such that said first and second conductor plates are substantially insulated, and one end of each of said first and second band members is connected to said radio apparatus;

b) a band connector attached to said first band member, for forming a loop of variable length by detachably connecting said first and second band members at one of a predetermined plurality of band connection positions, and having an electrode provided thereon such that when said first and second band members are connected by said band connector an overlap capacitance is formed between said electrode and said second conductor plate; and c) a resonance frequency compensation means operable for changing the magnitude of said overlap capacitance in proportion to a change in antenna inductance, wherein said change in antenna inductance is caused by change in antenna loop length.

* * * * *